US007139512B2

(12) United States Patent
Namiki et al.

(10) Patent No.: US 7,139,512 B2
(45) Date of Patent: Nov. 21, 2006

(54) CHARGING DEVICE, PROCESS CARTRIDGE AND IMAGE FORMING APPARATUS

(75) Inventors: Akiyo Namiki, Kanagawa-ken (JP); Takayuki Maruta, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/271,732

(22) Filed: Nov. 14, 2005

(65) Prior Publication Data

US 2006/0062598 A1 Mar. 23, 2006

Related U.S. Application Data

(62) Division of application No. 10/342,370, filed on Jan. 15, 2003, now abandoned.

(30) Foreign Application Priority Data

Jan. 17, 2002 (JP) ..... 2002-009284

(51) Int. Cl.
*G03G 15/02* (2006.01)

(52) U.S. Cl. ..... 399/176

(58) Field of Classification Search ..... 399/115, 399/168, 174, 176; 361/214
See application file for complete search history.

(56) References Cited

U.S. PATENT DOCUMENTS

| | | | |
|---|---|---|---|
| 5,096,795 A | 3/1992 | Yu | |
| 5,576,805 A | 11/1996 | Ishihara et al. | |
| 6,173,142 B1 | 1/2001 | Kawakami | |
| 6,721,523 B1 | 4/2004 | Sugiura et al. | |
| 2001/0012460 A1 | 8/2001 | Sato et al. | |

FOREIGN PATENT DOCUMENTS

| | | | |
|---|---|---|---|
| JP | 6-35299 | | 2/1994 |
| JP | 06324554 A | | 11/1994 |
| JP | 07104557 A | | 4/1995 |
| JP | 7-209959 | | 8/1995 |
| JP | 2002055508 A | * | 2/2002 |
| JP | 2002-139895 | | 5/2002 |

* cited by examiner

*Primary Examiner*—David M. Gray
*Assistant Examiner*—Ryan Gleitz
(74) *Attorney, Agent, or Firm*—Oblon, Spivak, McClelland, Maier & Neustadt, P.C.

(57) ABSTRACT

A charging device includes a charging member disposed opposite to a surface of an image carrier. The image carrier is charged by applying a voltage to the charging member, and the charging member includes a substrate and a resistor layer thereon. The resistor layer is disposed with two spacers contacting with the image carrier, so that a gap is created between the image carrier and the resistor layer between the two spacers, wherein width variation of the gap with time is prevented. The end portions of the resistor layer of the charging member protrude above the resistor layer between them, and the spacers are constituted by protrudent fractions of the end portions of the resistor layer.

11 Claims, 14 Drawing Sheets

CHARGING DEVICE, PROCESS CARTRIDGE AND IMAGE FORMING APPARATUS

CROSS-REFERENCE TO RELATED APPLICATION

This application is a Divisional Application of Ser. No. 10/342,370 filed on Jan. 15, 2003, now abandoned claims the priority benefit of Japanese application serial no. 2002-009284, filed Jan. 17, 2002.

BACKGROUND OF THE INVENTION

1. Field of the Invention

The present invention relates to a charging device for charging an image carrier, a process cartridge incorporating the charging device, and an image forming apparatus incorporating the charging device.

2. Description of the Related Art

One type of image forming apparatus that charges an image carrier with a charging device, forms an electrostatic latent image on the charged image carrier and then visualizes the electrostatic latent image as a toner image is well known in the prior art. Such an image forming apparatus may constitute an electronic copy machine, a facsimile machine, a printer, or a composite machine that has at least two functions mentioned above. A well-known charging device used in such an image forming apparatus is described in, for example, Japanese Patent Application Laid Open No. Hei 5-27555, including a charging member that is disposed opposite to an image carrier and applied with a voltage for charging the latter. The charging operation is effected by a discharge between the charging member and the image carrier. A charging member used in such a charging device is disposed opposite to the image carrier, and generally comprises a conductive substrate and a resistor layer thereon. The end areas of the resistor layer are disposed with spacers contacting with the image carrier, so that a small gap is created between the image carrier and the resistor layer between the spacers. Since the portion of the resistor layer opposite to the image carrier is located apart from the surface of the image carrier with a small gap between them, it is possible to reduce contamination on the surface of the resistor layer that is conventionally caused by contact between the image carrier and said portion of the resistor layer. Meanwhile, the aforementioned charging device is advantageous over those using Corona dischargers because the former generate less ozone and allow the use of a lower voltage applied to the charging member.

In the charging device used in the prior art, the end areas of the resistor layer are adhered with gap tapes by means of an adhesive. The gap tapes contacting with the image carrier so that a small gap is created between the surface of the image carrier and the resistor layer between the gap tapes. Though the gap tapes can serve as spacers, it is noted that the use of gap tapes causes the following problems.

The width of the small gap between the surface of the image carrier and the resistor layer between the spacers is preferably held constant for a long time. For example, as the width of the small gap continuously decreases, the resistor layer between the spacers will come into contact with the surface of the image carrier. Therefore, some contaminants like toners are adhered to the resistor layer, and the charging member is contaminated. Consequently, the charging characteristics for the image carrier are altered to cause abnormal electrification, and the quality of the toner image formed on the image carrier is deteriorated. On the contrary, as the width of the small gap continuously increases, abnormal discharge will occur to cause poor electrification of the image carrier, and the quality of the toner image therefore is deteriorated.

Moreover, the gap tapes are easily peeled off and damaged as subjected to an external force because they are merely adhered on the surface of the resistor layer. As the gap tapes are damaged like this, the width of the small gap between the surface of the image carrier and the resistor layer between the gap tapes is changed, and abnormal electrification of the image carrier is caused deteriorating the image quality.

Furthermore, since the gap tapes adhered to the surface of the resistor layer of the charging member with an adhesive are pressed on the image carrier and the image carrier comprises a hard material, a large pressure is imposed on the adhesive. Therefore, the adhesive is easily extruded from between the resistor layer and the gap tapes. Consequently, a small portion of the extreme small amount of toner on the surface of the image carrier is adhered to the extruded adhesive, and the thickness of the toner adhered to the adhesive increases time by time. As the thickness is eventually larger than the total thickness of the gap tapes and the adhesive under it, the toner contacts with the image carrier. Therefore, the width of the small gap is affected by the adhered toners to be overly large, and poor electrification of the image carrier is caused deteriorating the image quality.

SUMMARY OF THE INVENTION

In the view of the foregoing, one aspect of this invention is to provide a charging device capable of maintaining a constant small gap width for a long time. Another aspect of this invention is to provide a process cartridge that incorporates the charging device of this invention, and still another aspect is to provide an image forming apparatus that incorporates the charging device of this invention.

A charging device of this invention comprises a charging member disposed opposite to a surface of an image carrier, while the image carrier is charged with a voltage applied to the charging member. The charging member comprises a substrate and a resistor layer thereon, wherein the end portions of the resistor layer are disposed with spacers contacting with the image carrier, so that a gap is created between the image carrier and the resistor layer between the spacers. The end portions of the resistor layer protrude above the resistor layer between them, and the spacers are constituted by protrudent fractions of the end portions of the resistor layer.

Another charging device of this invention comprises a charging member disposed opposite to a surface of an image carrier, while the image carrier is charged with a voltage applied to the charging member. The charging member comprises a substrate and a resistor layer thereon, wherein the end portions of the resistor layer are disposed with spacers that are constituted by gap holders adhered to the end portions with an adhesive. The gap holders contacting with the image carrier, so that a gap is created between the image carrier and the resistor layer between the gap holders. The end portions of the resistor layer adhered with the gap holders form indents lower than the resistor layer between the gap holders, and the adhesive is applied to the indents.

Moreover, in any one of the aforementioned charging devices of this invention, the spacers preferably protrude above the resistor layer between them by from 5 μm to 500 μm.

In addition, in any one of the aforementioned charging devices and their modifications of this invention, the resistor layer preferably includes a resistance regulating layer on the substrate and a surface layer on the resistance regulating layer. The base material of the resistance regulating layer is a gum or a resin that has a hardness higher than 80° in JIS-A specification.

Furthermore, in any one of the aforementioned charging devices and their modifications of this invention, the resistor layer preferably includes a resistance regulating layer on the substrate and a surface layer on the resistance regulating layer, wherein the resistor layer comprises a base material and a resistance regulating agent therein that has an amount from 30 wt % to 90 wt %.

Moreover, in any one of the aforementioned charging devices and their modifications of this invention, the resistor layer preferably comprises a resistance regulating layer on the substrate and a surface layer on the resistance regulating layer, wherein the surface layer has a thickness from 1 μm to 20 μm between the spacers.

In addition, each of the aforementioned charging devices and their modifications of this invention preferably further comprises a cleaning member that contacts with the charging member for cleaning the latter.

Furthermore, in any one of the aforementioned charging devices and their modifications of this invention, the charging member preferably comprises a rotating body, and the cleaning member is preferably supported in contact with the charging member and rotated accompanying with the charging member.

Moreover, in any one of the aforementioned charging devices and their modifications of this invention, the cleaning member preferably comprises a brush that contacts with the charging member.

Furthermore, in any one of the aforementioned charging devices and their modifications of this invention, the cleaning member is preferably supported so that it can be moved back and forth and swung on the charging member.

This invention also provides a process cartridge, which comprises any one of the aforementioned charging devices and their modifications of this invention, and an image carrier charged by the charging device.

This invention further provides an image forming apparatus, which comprises any one of the aforementioned charging devices and their modifications of this invention, and an image carrier charged by the charging device.

Moreover, in the image forming apparatus of this invention, the image carrier preferably has a surface layer that contains fillers.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings, FIG. 1 schematically illustrates a cross-sectional view of the whole constitution of an image forming apparatus according to an embodiment of this invention.

DESCRIPTION OF THE PREFERRED EMBODIMENTS

Figure 1:
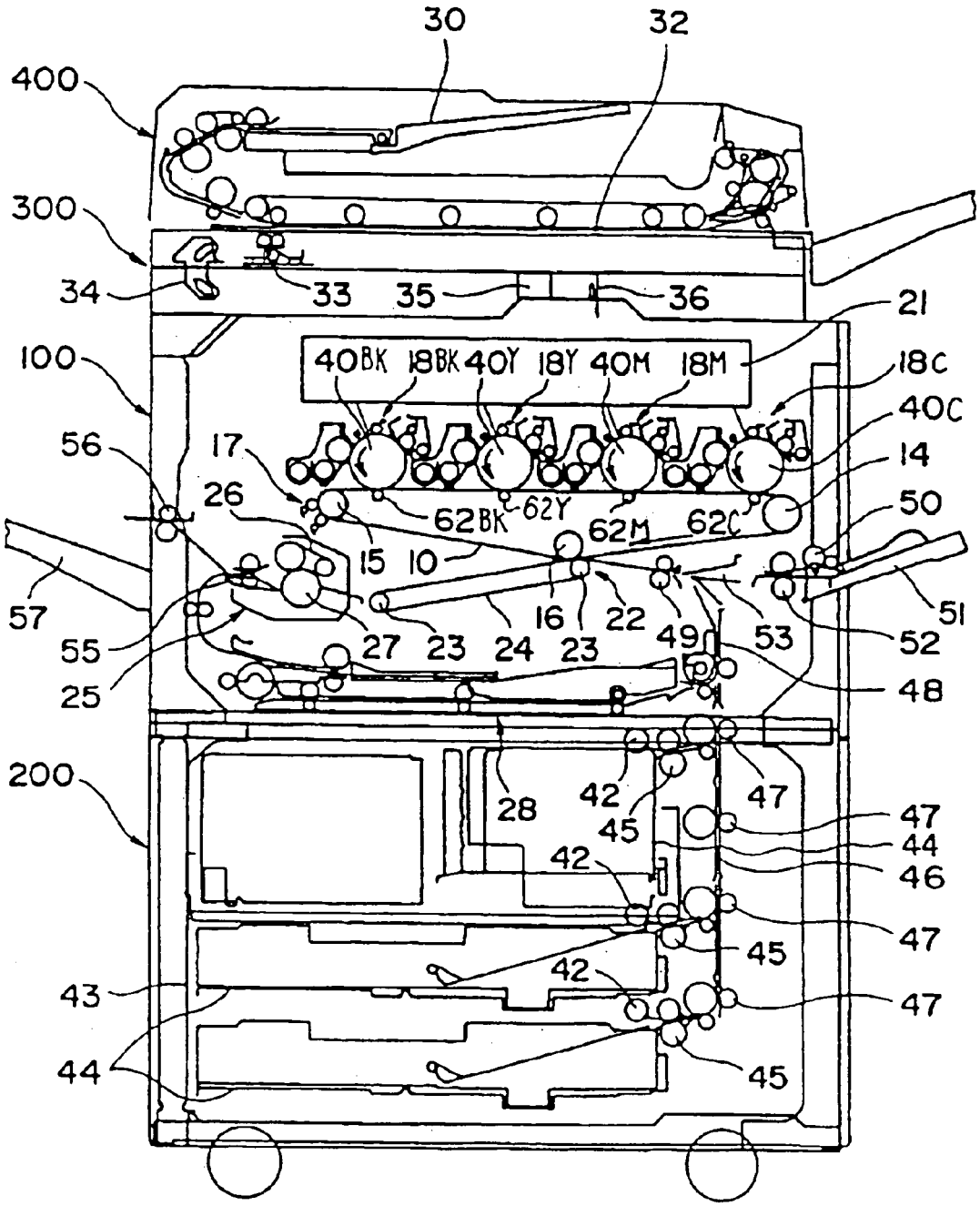

The embodiments of this invention are to be described in detail referring to the drawings.

FIG. 1 schematically illustrates an example of the image forming apparatuses that use an electrophotographic mechanism. The image forming apparatus comprises a sheet feeding table 200, an image forming part 100 supported on the sheet feeding table 200, a scanner 300 mounted on the image forming part 100, and an automatic original feeder 400 mounted on the scanner 300. The image forming apparatus illustrated in FIG. 1 constitutes an electronic copy machine.

The scanner 300 comprises a contact glass 32 for holding the original (not shown), and a first traveling body 33 having a light source and a first mirror, a second traveling body 34 having a second and a third mirrors, an image forming lens 35 and a reading sensor 36 disposed under the contact glass 32. The reading sensor 36 is constituted by, for example, a charge-coupled device (CCD).

When the image forming apparatus in FIG. 1 is being used for copying, the original is set on an original table 30 of the automatic original feeder 400. The automatic original feeder 400 is started to set the original on the contact glass 32 of the scanner 300, and then the automatic original feeder 400 is turned off. By using the automatic original feeder 400, the movements of the original on the contact glass 32 can be controlled.

Moreover, after the start switch (not shown) of the machine is pressed down and the original is set by the automatic original feeder 400 and fed onto the contact glass 32, or after the original is directly set on the contact glass 32, the scanner 300 is immediately started. During the operation of the scanner 300, the first and the second traveling body 33 and 34 both are moved to the right side of FIG. 1 from their home positions. Meantime, the original placed on the contact glass 32 is illuminated by a light emitted from the light source of the first traveling body 33. The reflected light is further reflected by the first mirror of the first traveling body 33 and the second and the third mirrors of the second traveling body 34, and then transmitted through the image forming lens 35 to form an image of the original on the reading sensor 36. Thus, the image contents of the original image are obtained.

On other hand, the image forming part 100 is operated following the steps described below to form an image record, which corresponds to the image information obtained with the aforementioned method.

Figure 2:
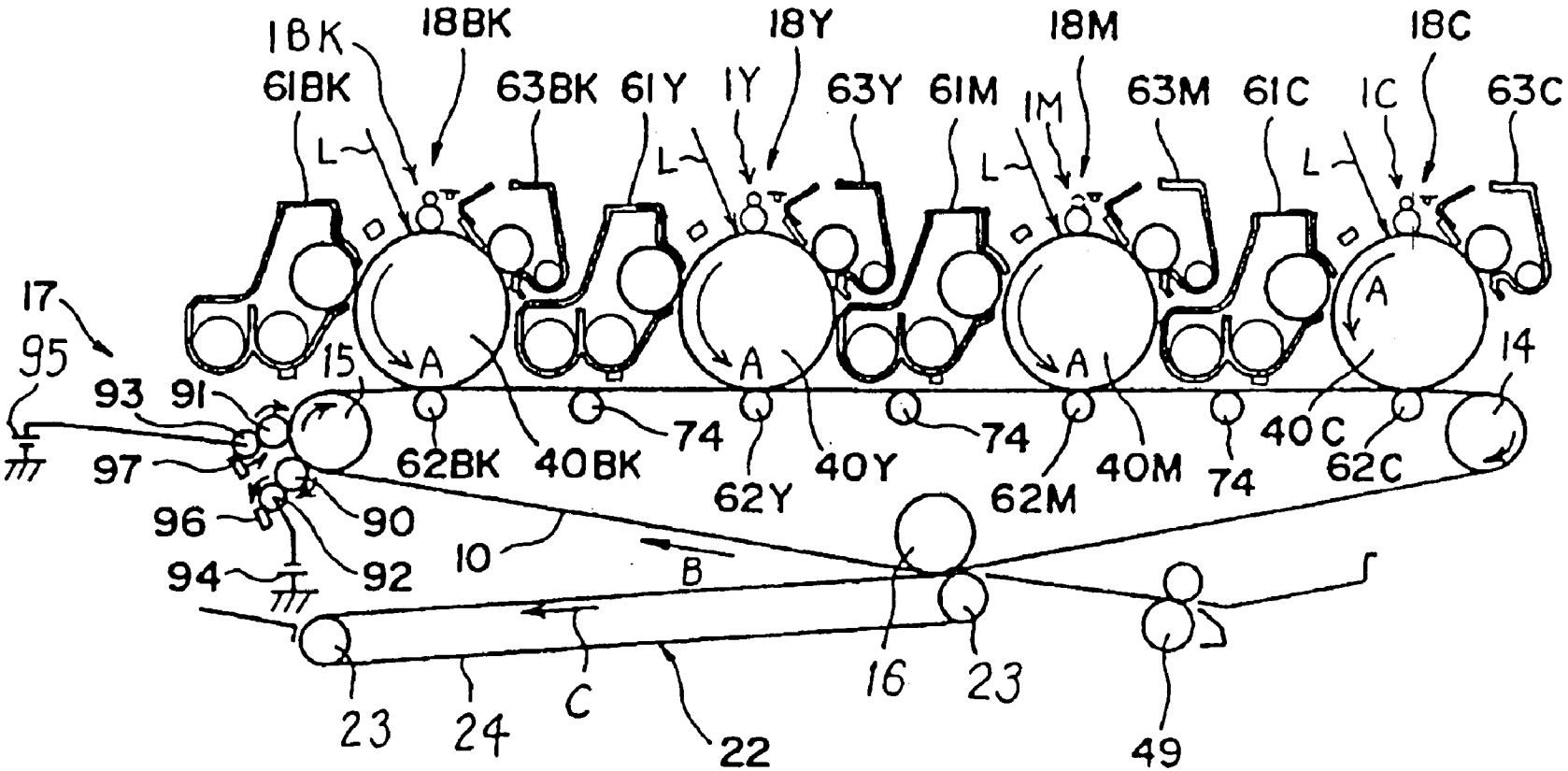
FIG. 2 illustrates a locally magnified view of FIG. 1.

The image forming part 100 in FIG. 1 is further illustrated in FIG. 2 in a magnified view. The image forming part 100 comprises a first to a fourth image forming means 18BK, 18Y, 18M and 18C that are disposed in its housing body. A black toner image, a yellow toner image, a magenta toner image and a cyan toner image are formed on the image carriers 40BK, 40Y, 40M and 40C, respectively, of the image forming means, and the toner image of each color is transferred to an intermediate transfer body 10. The intermediate transfer body 10 is constituted of an endless belt that is supported and driven by a first to a third rollers 14, 15 and 16. The first to the fourth image forming means 18BK, 18Y, 18M and 18C are disposed over the portion of the intermediate transfer body 10 between the first roller 14 and the second roller 15, and along the moving direction of the surface of that portion (horizontal direction). Such an image forming apparatus is called a tandem-type image forming apparatus. In the subsequent descriptions, the reference characters 40BK, 40Y, 40M and 40C are assigned to the first image carrier, the second image carrier, the third image carrier and the fourth image carrier, respectively, as it is necessary to distinguish between the four image carriers 40BK, 40Y, 40M and 40C.

As shown in FIG. 2, each image carrier (40BK, 40Y, 40M or 40C) is constituted of a drum photosensor driven rotating in the direction of arrow A. However, the image carrier may be constituted of a photosensor formed as an endless belt that can be supported and driven by plural supporting rollers. Analogously, though the intermediate transfer body 10 illustrated in FIGS. 1 and 2 is constituted of an endless belt that is driven in the direction of arrow B by the first to the third supporting rollers, the intermediate transfer body may have a drum-like shape.

The mechanisms for transferring the toner images of four colors from the first to the fourth image carriers 40BK, 40M, 40Y and 40C, respectively, to the intermediate transfer body 10 are substantially the same. Therefore, only the mechanism for transferring a black toner image on the first image carrier 40BK to the intermediate transfer body 10 is explained below as an example.

Figure 3:
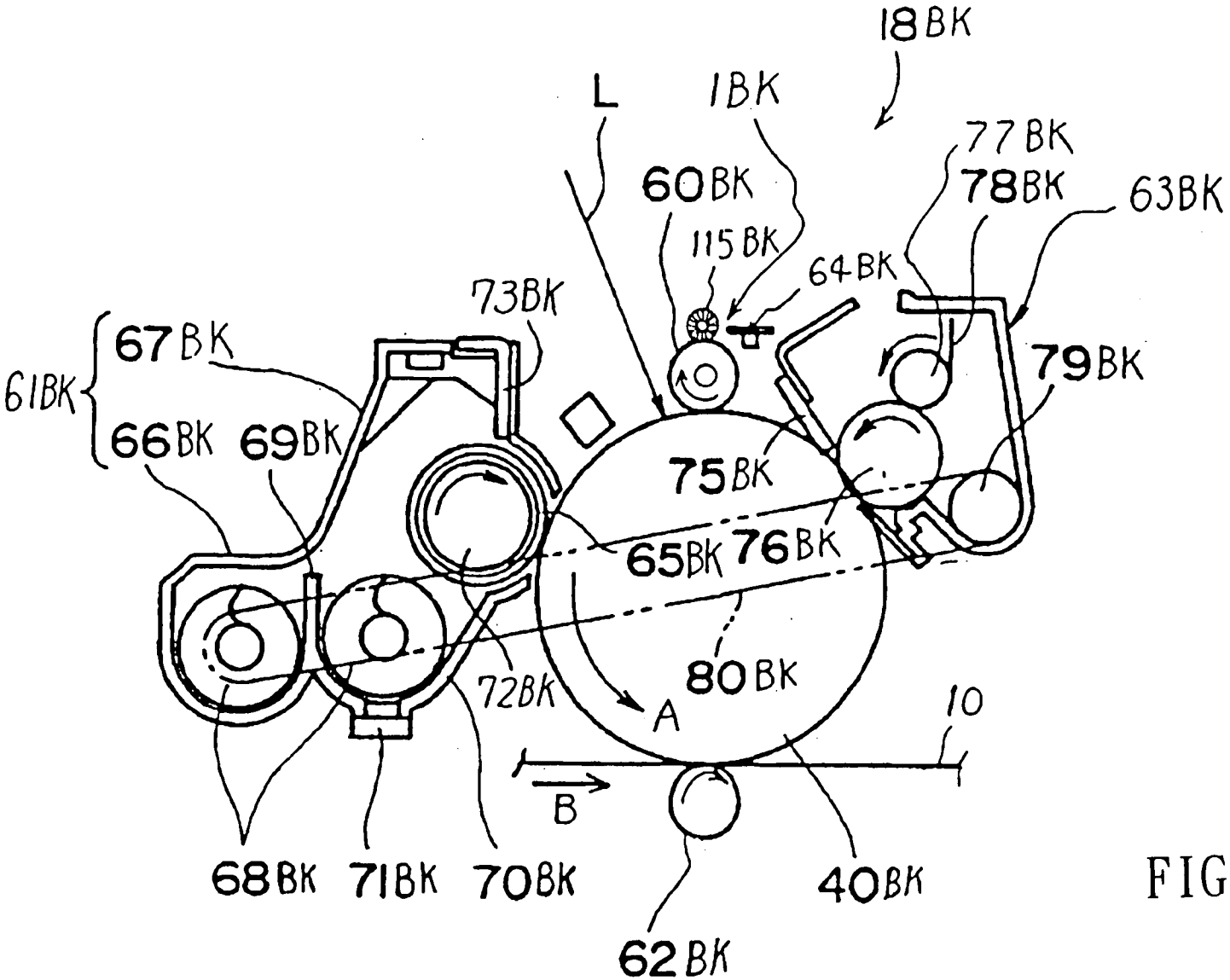
FIG. 3 illustrates a magnified view of a portion of FIG. 2.

FIG. 3 illustrates a magnified view of the first image carrier 40BK and the other image forming elements disposed around it. In an image forming operation, the image carrier 40BK is driven rotating in the direction of arrow A, and is simultaneously charged to a predetermined polarity, such as a minus polarity in the illustrated example, with a charging device 1BK. The charging device 1BK will be described in detail later. As shown in FIG. 1, an exposure device 21 is disposed over the image carrier 40BK. A writing light L (FIG. 3), which has been modulated corresponding to the image information obtained with the scanner 300 previously, is emitted from the exposure device 21. The writing light L illuminates the charged surface of the image carrier to form an electrostatic latent image thereon. The exposure device 21 may be constituted of a device that emits a writing light with a light source like laser or LED. In the illustrated embodiment, the portions of the image carrier illuminated by the writing light have a lower surface potential in absolute value, and form an electrostatic latent image. Meanwhile, the portions not illuminated by the writing light have a higher surface potential in absolute value, and form the ground of the image.

Figure 4:
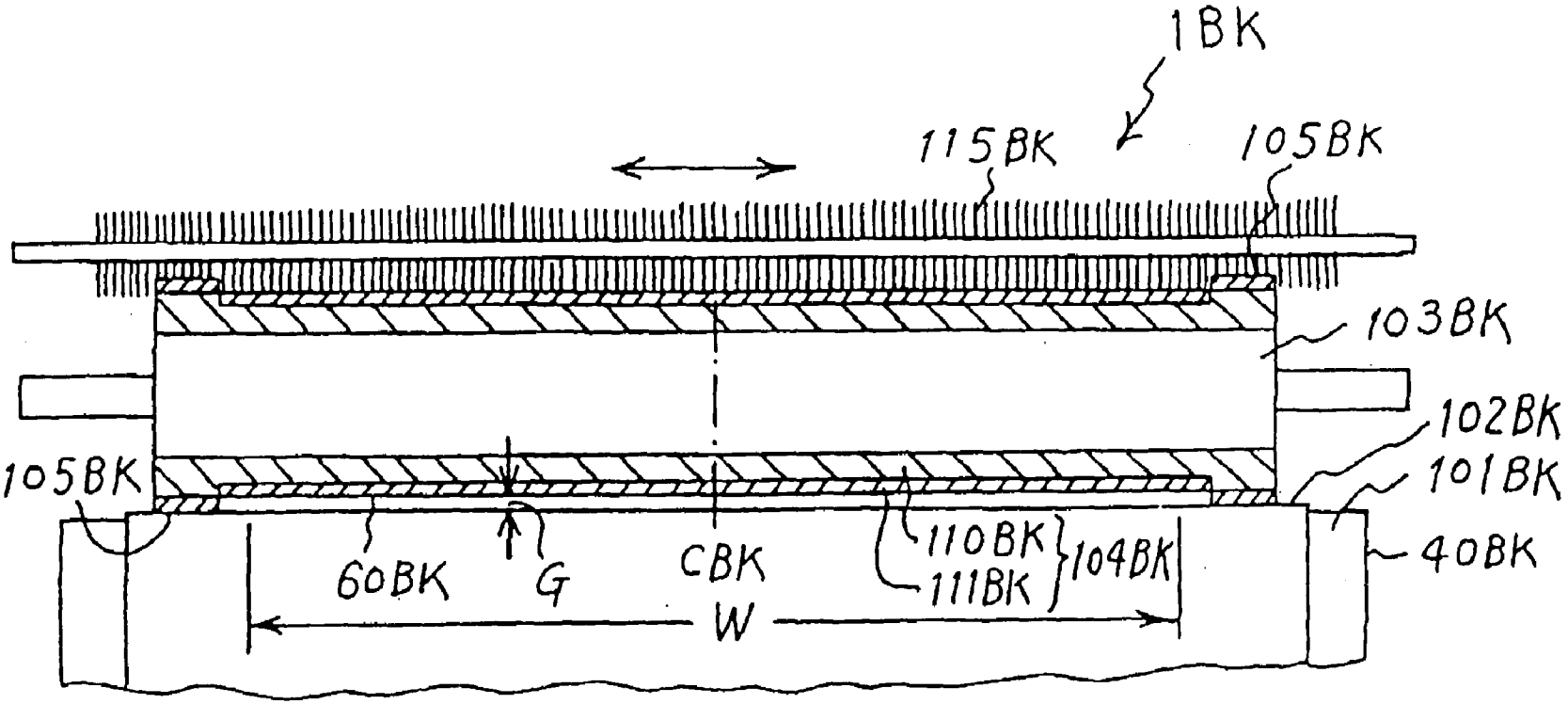
FIG. 4 illustrates a longitudinal cross-sectional view of a charging member according to an embodiment of this invention.
Figure 6:
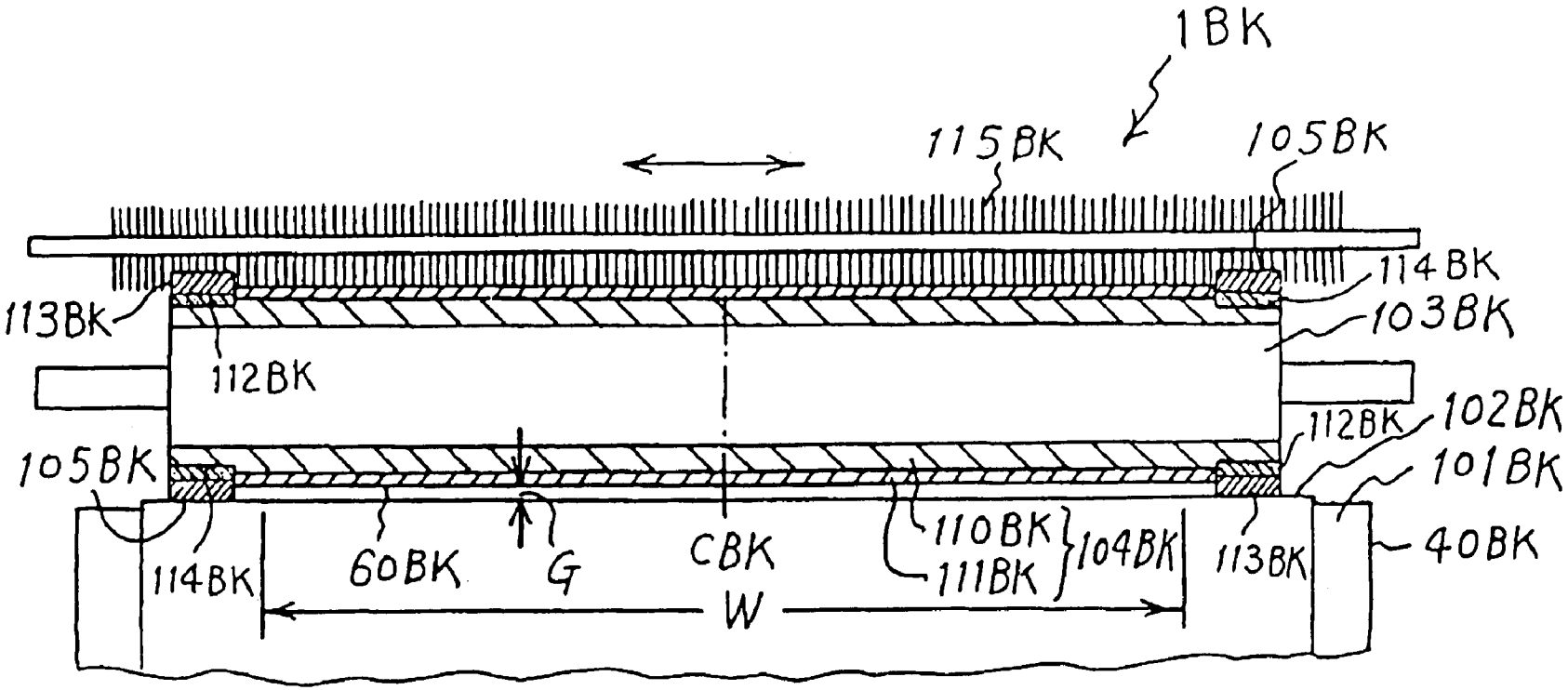
FIG. 6 illustrates a longitudinal cross-sectional view of a charging member according to another embodiment of this invention.

Thereafter, the electrostatic latent image is visualized as a black toner image by using a developing device 61BK. As shown in FIGS. 4 and 6, the image carrier 40BK includes a drum-like conductive supporting body 101BK and a photosensitive layer 102BK formed on its periphery. The photosensitive layer 102BK is charged and exposed as described above for forming an electrostatic latent image thereon, and then the electrostatic latent image is visualized as a toner image. Besides, a photosensor formed as an endless belt mentioned above may also be used as an image carrier, where a photosensitive layer is supported by a conductive supporting body that is formed as an endless belt. The image carrier can be constituted of various structures, of which the specific examples are described later.

Figure 11:
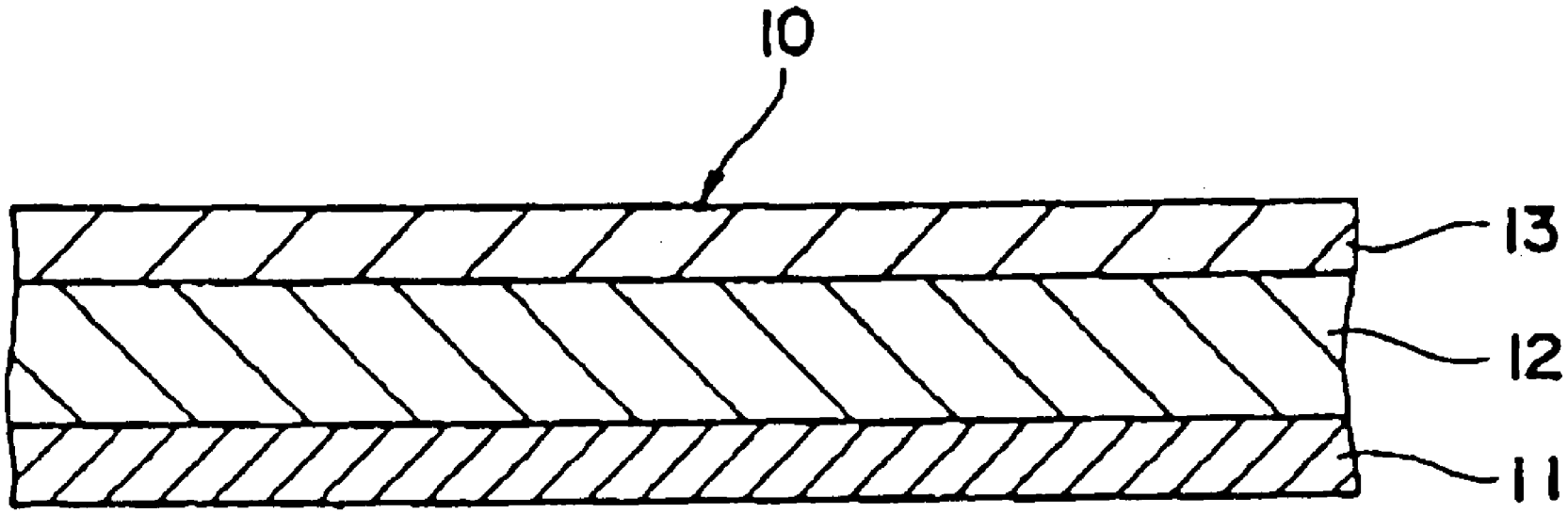
FIG. 11 illustrates a magnified cross-sectional view of an intermediate transfer body according to an embodiment of this invention.

To drive the intermediate transfer body 10 illustrated in FIGS. 1 and 2, one of the first to the third supporting rollers 14, 15 and 16 constitutes a driving roller, which is driven rotating by a driving motor (not shown). Thereby, as the intermediate transfer body 10 is driven in the direction of arrow B, the other two supporting rollers are also driven rotating. Referring to FIG. 11 that illustrates a magnified view of the intermediate transfer body 10, which comprises a base layer 11, an elastic layer 12 disposed on the base layer 11 and a surface layer 13 disposed on the elastic layer 12. The surface layer 13 is on the surface side of the intermediate transfer body 10, and the base layer 11 is on the inner side of the same.

Referring to FIG. 3 again, a primary transfer device 62BK is disposed opposite to the image carrier 40BK separated by the intermediate transfer body 10. In the illustrated embodiment, the primary transfer device 62BK is constituted of a transfer roller that is pressed onto the inner side of the intermediate transfer body 10 and driven rotating simultaneously. The primary transfer device 62BK is applied with a transfer voltage to have a polarity reverse to that of the toners in the toner image, such as a plus polarity in the illustrated embodiment. Thereby, the single-color black toner image formed on the first image carrier 40BK can be transferred to the intermediate transfer body 10 that contacts with the first image carrier 40BK and driven in the direction of arrow B synchronously with the first image carrier 40BK. Instead of the primary transfer device constituted of a transfer roller, one constituted of a conductive transfer brush or transfer blade, or one constituted of a Corona discharger disposed apart from the inner side of the intermediate transfer body 10 may also be used.

After the image carrier 40BK passes the transfer site where transfer is performed, the residual toner on the surface of the image carrier 40BK is removed with a cleaning device 63BK disposed with the image carrier 40BK, and the surface of the image carrier 40BK is thereby cleaned. Thereafter, a discharging device 64BK is used to discharge the surface of the image carrier, so as to initialize the surface potential for the formation of a new image next time. The discharging device is constituted of, for example, a discharging lamp that emits light to illuminate the surface of the image carrier 40BK for initializing the surface potential of the same.

Referring to FIG. 2 again, a yellow toner image, a magenta toner image and a cyan toner image are formed on the second to the fourth image carriers 40Y, 40M and 40C, respectively, with the same mechanism as described above. The three image carriers 40Y, 40M and 40C are disposed at the downstream side of the first image carrier 40BK along the moving direction of the intermediate transfer body 10. The toner image of each color is sequentially transferred to the intermediate transfer body 10, to which the black toner image has been transferred, with the effects of the other primary transfer devices 62Y, 62M and 62C. Consequently, a color image composed of four colors is formed on the intermediate transfer body 10.

In each related drawing, each image forming element in the second, the third and the fourth image forming means 18Y, 18M and 18C is indicated by the same number as that of the corresponding element in the image forming means 18BK, while the letter symbol attached after the reference number is changed to "Y", "M" or "C" from "BK". Since the fundamental constitutions and the mechanisms of the second to the fourth image forming means 18Y, 18M and 18C are similar except that a yellow toner image, a magenta toner image and a cyan toner image are formed on the image carriers 40Y, 40M and 40C via the developing devices 61Y, 61M and 61C, respectively, the explanations of the three image forming means 18Y, 18M and 18C are omitted. The examples of the constituting elements in an image forming means are described later.

Moreover, as shown in FIG. 2, several elements 74 formed as conductive rollers are disposed between the primary transfer devices 62BK, 62Y, 62M and 62C, and contact with the inner side, i.e., the base layer side, of the intermediate transfer body 10. These conductive rollers 74 are capable of preventing the current supplied to one primary transfer device (62BK, 62Y, 62M or 62C) from flowing to adjacent image forming means via the medium-resistance base layer of the intermediate transfer body 10 as an toner image is being transferred from the corresponding image carrier to the intermediate transfer body 10.

Moreover, a secondary transfer device 22 is disposed on the opposite side of the image carriers separated by the intermediate transfer body 10. The secondary transfer device 22 in this embodiment comprises an endless secondary transfer belt 24 supported by two rollers 23 and driven in the direction of arrow C, and the endless secondary transfer belt 24 is pressed on the third roller 16 separated by the intermediate transfer body 10.

Referring to FIG. 1 again, a paper feeder 43 is disposed in the sheet feeding table 200, comprising plural sheet feeding cassettes 44 and sheet feeding rollers 42 for feeding a recording medium (not shown) like transfer papers or resin sheets from inside the sheet feeding cassettes 44. Immediately after the start switch is pressed down, the sheet feeding roller 42 corresponding to the selected sheet feeding cassette 44 is rotated to transport the recording medium piled up in the sheet feeding cassette 44. The recording medium is then transported into a sheet feeding path 46 one by one with a separating roller 45, and subsequently into the sheet feeding path 48 of the image forming part 100 via a transporting roller 47. The transported sheet is stopped as contacting with a pair of resist rollers 49.

Alternatively, the recording medium can be set on a manual input tray 51 and transported with the rotation of a sheet feeding roller 50. A separating roller 52 is then rotated to separate a single sheet out of the recording medium, and the separated sheet is transported to a sheet feeding path for manual input. The transported sheet is similarly stopped as contacting with the pair of resist rollers 49.

In any case of the two, the pair of resist rollers 49 start to rotate with a timing matching both the color image synthesis on the intermediate transfer body 10 and the recording medium. With the rotation of the resist rollers 49, the recording medium is transported between the intermediate transfer body 10 and the secondary transfer belt 24. The color image synthesized on the intermediate transfer body 10 is then secondarily transferred onto the recording medium with the secondary transfer device 22. The residual toners on the intermediate transfer body 10, which were not transferred to the recording medium, are removed by a cleaning device 17 that is disposed opposite to the second supporting roller 15 separated by the intermediate transfer body 10, so that the surface of the intermediate transfer body 10 is cleaned. Therefore, subsequent toner images can be transferred to the intermediate transfer body 10 and be synthesized to form a color image thereon.

The recording medium with a synthetic color image thereon is continuously transported by the secondary transfer belt 24 to pass a fixing device 25 illustrated in FIG. 1, where the synthetic color image is fixed on the recording medium with heat and pressure. After passing the fixing device 25, the recording medium is ejected to an ejection tray 57 by an ejecting roller 56. The aforementioned secondary transfer belt 24 has a sheet transportation function for transporting the recording medium to the fixing device 25 after the image transfer. The fixing device 25 illustrated in FIG. 1 comprises an endless fixing belt 26 and a pressurizing roller 27 pressed thereon, while the recording medium is transported through between the fixing belt 26 and the pressurizing roller 27 to have the synthetic color image be fixed thereon. Besides, the secondary transfer device comprising a secondary transfer belt 24 can be replaced with one that incorporates a Corona charger disposed apart from the transfer roller or the intermediate transfer body 10.

Moreover, a sheet reversing device 28 is disposed under the secondary transfer device 22 and the fixing device 25 in the image forming apparatus in FIG. 1, capable of reversing the recording medium for forming images on the two sides thereof. As a second image is to be formed on the other side of a recording medium, the same one passing the fixing device 25 is switched to the sheet reversing device 28 by a switching pawl 55. The recording medium is turned up side down in the sheet reversing device 28, and then transported through between the intermediate transfer body 10 and the secondary transfer device 22. A newly synthesized color image on the intermediate transfer body 10 is transferred onto the upward side of the recording medium, and then fixed on the recording medium by the fixing device 25. Thereafter, the recording medium is rejected to the ejection tray 57 via the ejecting roller 56.

Figure 12:
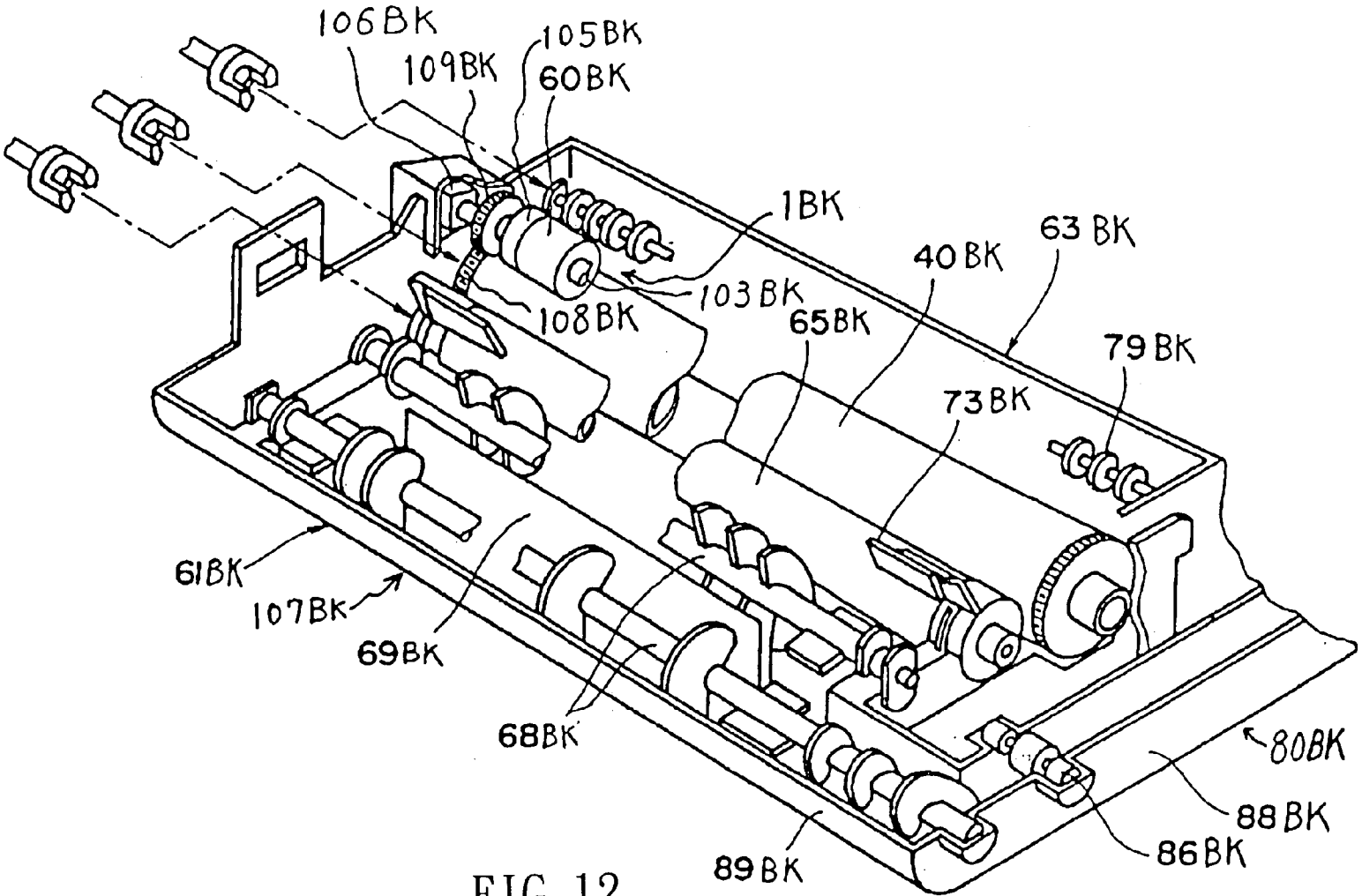
FIG. 12 illustrates a fractured perspective view of a process cartridge according to an embodiment of this invention.

The specific constitution of the charging devices 1BK, 1Y, 1M and 1C disposed in the image forming means 18BK–18C, respectively, are described below, wherein the charging device 1BK in the first image forming means 18BK is taken as an example. As shown in FIGS. 3, 4 and 12, the charging device 1BK comprises a charging member 60BK disposed opposite to the surface of the image carrier 40BK. The charging member 60BK can be formed with any suitable structure, such as a cylindrical roller as illustrated in the drawing. The charging roller 60BK comprises a cylindrical conductive substrate 103BK and a resistor layer 104BK covering the periphery of the substrate 103BK and fixed thereto, wherein the longitudinal end areas of the resistor layer 104BK are disposed with spacers 105BK that contact with the image carrier 40BK.

The so-called "end areas" of a resistor layer means the longitudinal end portions of the resistor layer, or the locations apart from the ends of the resistor layer in the direction toward the longitudinal center CBK of the same. Though the spacers 105BK illustrated in the drawing are disposed on the longitudinal end portions of the resistor layer 104BK, they may alternatively be disposed on the locations apart from the ends of the resistor layer by several millimeters along the direction toward the longitudinal center CBK of the same. Moreover, in spite that only two spacers are disposed as illustrated in the drawing, there can be three or more spacers in other cases. That is, the minimal number of the spacers is 2.

The periphery of each spacer 105BK has a cylindrical shape, and has a larger outer diameter than that of the cylindrical periphery of the other portion of the resistor layer. Since the spacers 105BK contact with the image carrier 40BK, a small gap is created between the image carrier 40BK and the opposite portion of the resistor layer between the spacers 105BK. The small gap, which is defined as the gap between the image carrier 40BK and the resistor layer between the spacers 105BK in the closest parts of the two, is set to 5 μm–500 μm.

The substrate 103BK comprises a high-rigidity material that has a volume resistance lower than $10^3$ Ω·cm, preferably lower than $10^2$ Ω·cm. For example, the substrate 103BK may be formed from a metallic material like stainless steel or aluminum with a diameter of 8 mm–20 mm, or from a high-rigidity conductive resin, etc. In this embodiment, the substrate 103BK constitutes the core shaft of a charging roller.

The longitudinal ends of the aforementioned substrate 103BK is supported by a supporting body via a bearing 106BK, such that the substrate 103BK can be rotated freely. As shown in the embodiment illustrated in FIG. 12, a portion of the cartridge case 89BK (described later) constitutes the supporting body. Each bearing 106BK is pressurized with a pressurizing means (not shown) like compressive springs, so that the spacers 105BK of the charging members 60BK can be pressed onto the image carrier 40BK.

When the image carrier 40BK is rotated in an image forming operation, the charging member 60BK is rotated clockwise (FIG. 3) with two spacers 105BK thereof being pressed on the image carrier 40BK. In this case, the charging member 60BK may be rotated accompanying with the rotation of the image carrier 40BK by utilizing the friction force between them. In other cases, the charging member 60BK can be driven rotating accompanying with the rotation of the image carrier 40BK by engaging a gear 108BK disposed on the image carrier 40BK and a gear 109BK fixed to the substrate 103BK of the charging member 60BK, as shown in FIG. 12. Besides, the charging member 60BK may be simply disposed opposite to the image carrier 40BK without rotation.

The conductive substrate 103BK of the charging member 60BK is electrically connected to a power source (not shown), and is applied with a voltage from the power source in an image forming operation. Thereby, a discharge phenomenon can be induced in the small gap between the charging member 60BK and the image carrier 40BK, and the image carrier 40BK (more precisely, the photosensitive layer 102BK thereof) is charged with a predetermined electrical potential. With this mechanism, the image carrier 40BK is charged with a voltage applied to the charging member 60BK. The voltage applied to the charging member 60BK may be a DC voltage, or one formed by superimposing an AC voltage on a DC voltage.

Moreover, in the illustrated embodiment, the resistor layer 104BK of the charging member 60BK comprises a circular resistance regulating layer 110BK on the surface of the substrate 103BK and a surface layer 111BK covering the surface of resistance regulating layer 110BK. The resistor layer may also be constituted of any other suitable structure. For example, the surface layer may be omitted so that the resistance regulating layer alone constitutes a resistor layer, or the resistor layer may be constituted by three or more layers.

The volume resistance of the resistance regulating layer 110BK is set to, for example, $10^5$–$10^9$ Ω·m, and the thickness of the same is set to 1–2 mm, for example. The volume resistance of the surface layer 111BK is set to, for example, $10^6$–$10^{10}$ Ω·m, and is preferably higher than that of the resistance regulating layer 110BK. The thickness of the surface layer 111BK is preferably 1–20 μm. As the volume resistance of the resistance regulating layer 110BK is higher than $10^9$ Ω·m, the discharge amount is not sufficient, and the surface of the image carrier is poorly charged. As the volume resistance of the resistance regulating layer 110BK is lower than $10^5$ Ω·m, the discharge current may concentrate at pinholes possibly form on the photosensitive layer 102BK of the image carrier 40BK, and an abnormal discharge is caused. The resulting overcurrent may further expand the pinholes and therefore damage the photosensitive layer 102BK. The surface layer 111BK is disposed to protect the surface of the charging member 60BK from some contaminants like the toners, and therefore has to be formed from a highly releasable material. The specific materials of the resistance regulating layer 110BK and the surface layer 111BK will be described later.

Figure 5:
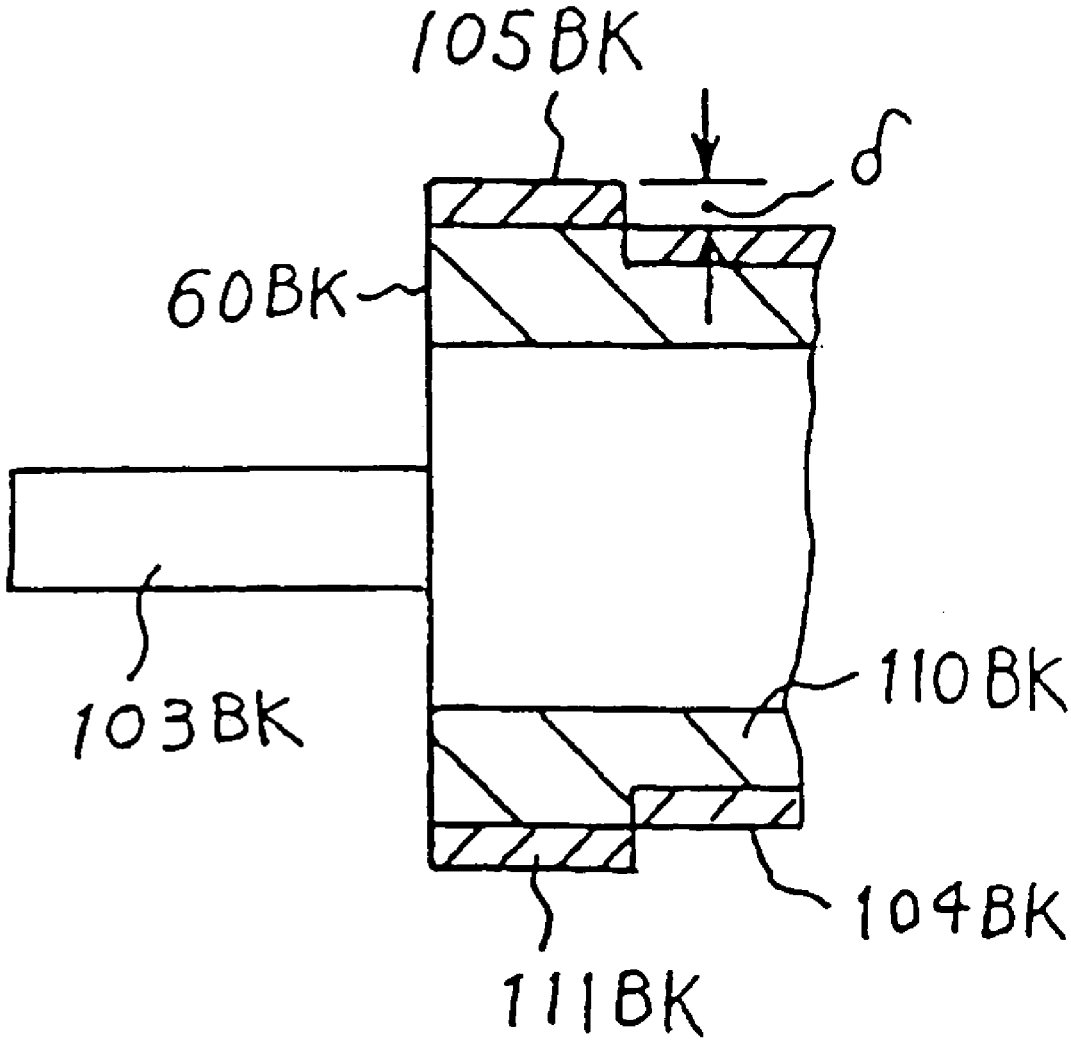
FIG. 5 illustrates a magnified cross-sectional view of a portion of the charging member in FIG. 4.

Referring to FIGS. 4 and 5, in the charging device 1BK of this embodiment, the longitudinal end portions of the resistor layer 104BK protrude in the radial direction as compared with the portion of the resistor layer between them, while the protrudent fractions of the end portions constitute the aforementioned spacers 105BK. The spacers 105BK may be formed by increasing the thickness of the resistance regulating layer 110BK in the end areas of the resistor layer 104BK relative to the other portions of the same, as shown in the illustrated embodiment. However, the spacers 105BK may also be formed by increasing the thickness of the surface layer 111BK, or the total thickness of resistance regulating layer 110BK and the surface layer 111BK, in the end areas of the resistor layer 104BK.

As mentioned above, the spacers 105BK can be constituted by increasing the thickness of the longitudinal end portions of the resistor layer 104BK relative to the other portions of the same. That is, the spacers 105BK are constituted by a portion of the resistor layer 104BK. Therefore, the peeling-off problem in the prior art, which is caused by using gap tapes adhered to the surface of the resistor layer 104BK as spacers, can be avoided because such spacers 105BK are not easily peeled off and damaged. Consequently, the width of the small gap between the image carrier 40BK and the resistor layer 104BK between the two spacers 105BK can be held constant for a long time. Therefore, the quality of the images formed with the image carrier 40BK can be maintained constantly, and the lifetime of the charging member 60BK can be increased.

The methods for forming the resistance regulating layer 110BK and the surface layer 111BK on the substrate 103BK include the two described below. One method is using a die to mold a resistance regulating layer 110BK and a surface layer 111BK on the substrate 103BK, and another is using an ordinary coating method like spray coating to coat the substrate 103BK with a resistance regulating layer 110BK and a surface layer 111BK.

FIG. 6 illustrates a charging device 1BK according to another embodiment. The fundamental constitution of the charging device 1BK in this embodiment is substantially the same as that of the one illustrated in FIGS. 4 and 5. That is, the charging device 1BK comprises a charging member 60BK disposed opposite to the surface of an image carrier 40BK. The charging member 60BK comprises a conductive substrate 103BK and a resistor layer 104BK fixed to the substrate 103BK, wherein the conductive substrate 103BK is applied with a voltage from a power source. The image carrier 40BK is charged with a voltage applied to the charging member 60BK, as described above.

The charging device in this embodiment differs from that illustrated in FIGS. 4 and 5 by that the spacers 105BK are constituted by two gap holders 113BK adhered to the end areas of the resistor layer 104BK with an adhesive 112BK. The two gap holders 113BK contact with the image carrier 40BK, so that a small gap is created between the image carrier 40BK and the resistor layer 40BK between the two gap holders 113BK. By inducing a discharge in the gap between the charging member 60BK and the image carrier 40BK, the image carrier 40BK (more precisely, the photosensitive layer 102BK) is charged with a predetermined electrical potential. In the illustrated embodiment, the gap holders 113BK are formed from gap tapes, which are constituted of tapes that are adhered to the adhesive layer 112BK applied previously. The tapes are adhered to the entire periphery of the end portions of the resistor layer 104. The aforementioned parts of the charging device constitution are the same as those of the conventional one.

Figure 7:
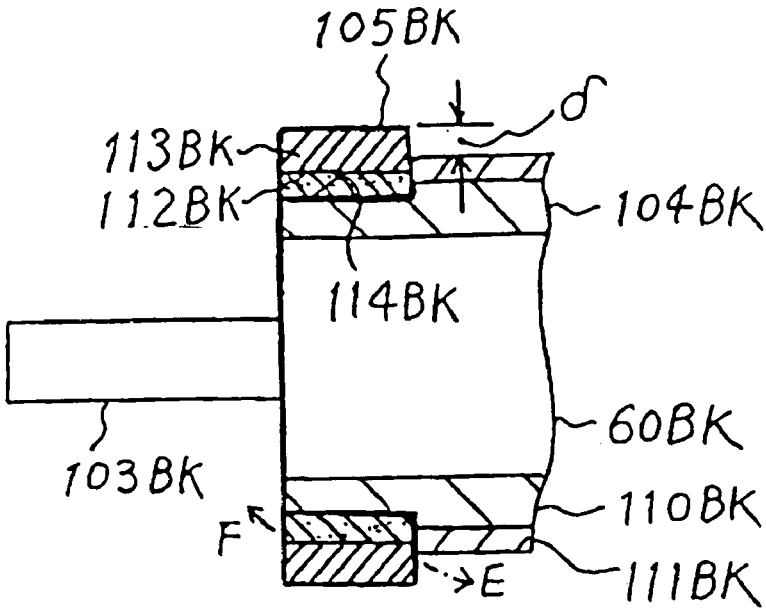
FIG. 7 illustrates a magnified cross-sectional view of a portion of the charging member in FIG. 6.

The differences between the aforementioned charging device and the conventional one are shown in FIGS. 6–7. The portions of the resistor layer 104BK adhered with the gap holders 113BK form indents 114BK that sink in the radial direction of the charging member 60BK as compared with the resistor layer 104BK between the gap holders 113BK, while the adhesive 112BK is embedded in the indents 114BK. The other constituting parts of the charging device 1BK illustrated in FIGS. 6–7 are the same as those described referring to FIGS. 1–5.

As mentioned above, the gap tapes adhered on the surface of the resistor layer of the charging member with an adhesive are pressed onto the image carrier, so a large pressure is imposed on the adhesive. Therefore, the adhesive is easily extruded in a conventional charging member, as indicated by the dot-dash arrow E in FIG. 7. Consequently, a small portion of the toners on the image carrier not removed by the cleaning device is adhered to the extruded adhesive, and the thickness of the toners on the adhesive increases time by time. Therefore, the width of the small gap is affected by the adhered toners, and eventually gets overly large.

In the charging member 60BK illustrated in FIGS. 6–7, however, the adhesive 112BK is located in the indents 114BK. Therefore, the adhesive 112BK is not easily extruded from where indicated by the dot-dash arrow E as imposed with a large pressure. Meanwhile, even if the adhesive 112BK is extruded from the indents 114BK, the extruded amount would be extremely small. Consequently, it is possible to prevent the gap width from getting overly large and to maintain it constant for a long time, and poor electrification of the image carrier and the accompanying deterioration of image quality can be avoided.

The resistance regulating layer 110BK is preferably constituted by a hard material, such as a hard resin material, so that the roundness of the charging member can be easily achieved, and the variation of the outer diameter of the same caused by environmental changes can be reduced. Thereby, the width of the small gap can be maintained constant effectively. In such a charging member of the prior art, however, the adhesive is easily extruded because it is subjected to a large pressure imposed by an image carrier that is as hard as the resistance regulating layer. For the charging member 60BK illustrated in FIGS. 6–7, however, extrusion of the adhesive can be effectively inhibited even though the resistance regulating layer 110BK is constituted by a hard material.

Moreover, as indicated by arrow F in FIG. 7, the adhesive 112BK is located on two opposite sides relative to the longitudinal center CBK of the charging member 60BK, so the surface of the resistor layer 104BK between the two spacers 105BK is not contaminated even if little adhesive is extruded by the image carrier. Therefore, the width of the small gap will not be increased.

Figure 8:
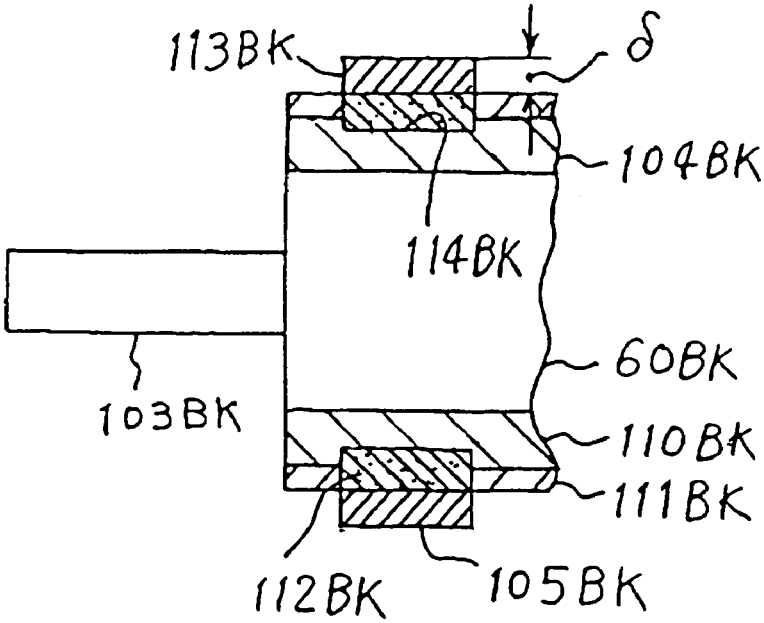
FIG. 8 illustrates a cross-sectional view of a portion of a charging member according to still another embodiment of this invention.

Moreover, as shown in FIG. 8, the indents 114BK may also be formed as circular grooves surrounding the end portions of the resistor layer 104BK, so that the adhesive 112BK embedded in the indents 114BK can be enclosed by the latter. In such a manner, extrusion of the adhesive 112BK can be prevented more effectively.

Furthermore, in the embodiment illustrated in FIGS. 6–8, the surface layer 111BK and a portion of the resistance regulating layer 110BK in the end areas of the resistor layer 104BK are removed to form the indents 114BK. Besides, if the thickness of the surface layer 111BK is large, the indents 114BK can be formed by cutting off the surface layer 111BK in the end areas of the resistor layer 104BK. Moreover, in the embodiment illustrated FIGS. 9–10, the indents 114BK are formed with a portion of the surface layer 111BK remaining under it, and the adhesive 112BK is disposed therein for adhering the gap holders 113BK to the resistor layer 104BK.

Figure 9:
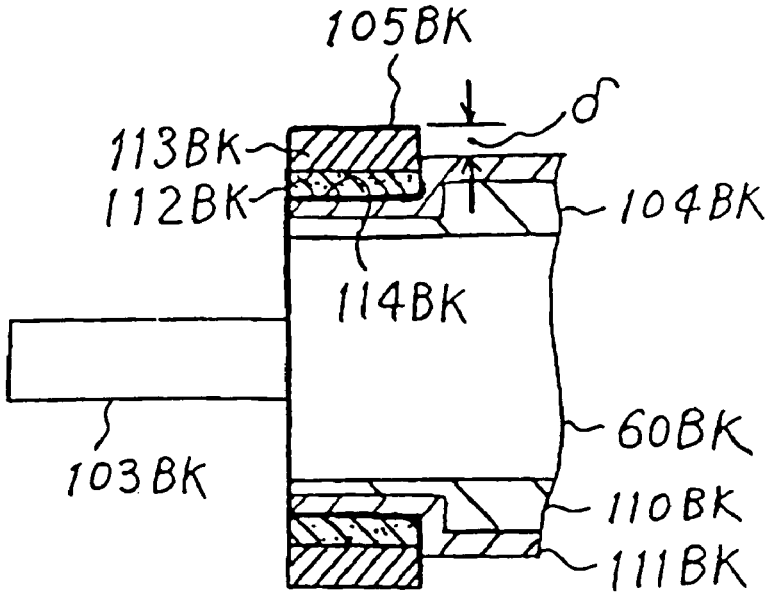
FIG. 9 illustrates a cross-sectional view of a portion of a charging member according to still another embodiment of this invention.
Figure 10:
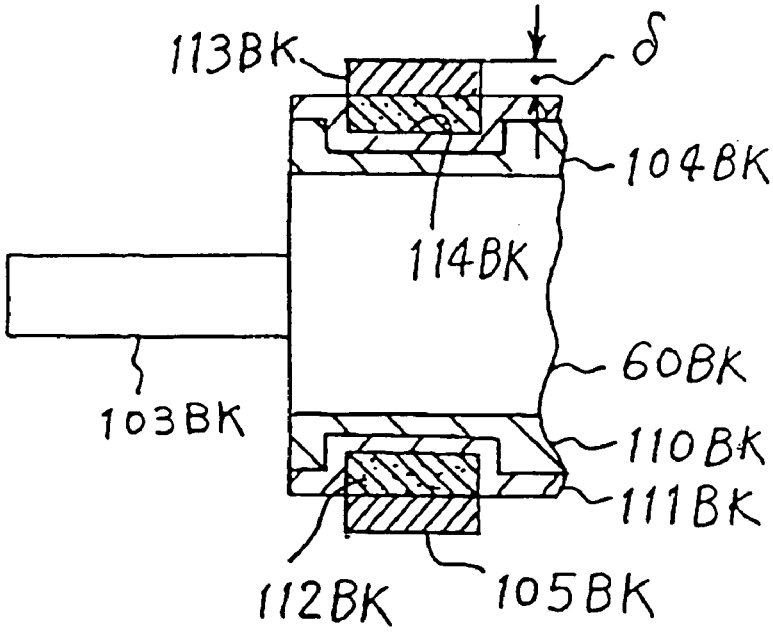
FIG. 10 illustrates a cross-sectional view of a portion of a charging member according to still another embodiment of this invention.

It is understood that the structure of the indents 114BK in FIGS. 6–10 can be applied to a charging member that has a resistor layer not including a surface layer. Moreover, the other parts of the charging device constitution illustrated in FIGS. 8–10 are the same as those of the charging device constitution in FIG. 6.

On the other hand, as shown in FIGS. 4–6, the spacers 105BK of the charging member 60BK contact with the photosensitive layer 102BK of the image carrier 40BK in the charging device 1BK of each embodiment described above. It is preferable to have the photosensitive layer 102BK contact with the spacers 105BK by the portions outside the image forming area "W" thereof. Since the spacers 105BK do not contact with the image forming area "W" in this design, the image forming area W can be charged evenly for forming high-quality images.

Besides, it is also feasible to have the spacers 105BK contact with the surfaces of the supporting body 101BK outside the photosensitive layer 102BK.

Moreover, the spacers 105BK in each type of charging member 60BK described above protrude in the radial direction of the charging member 60BK by a height "δ" relative to the resistor layer between the two spacers 105BK. The spacers 105BK are formed with a protruding height of 5

μm–500 μm, so that the width of the small gap is set to 5 μm–500 μm. As the width is smaller than 5 μm, the surface of the resistor layer 104BK between the spacers 105BK may possibly contact with the image carrier 40BK, and is easily contaminated by the latter. As the width is larger than 500 μm, poor electrification of the image carrier 40BK is caused.

As mentioned above, the resistor layer 104BK of the illustrated charging member 60BK comprises a resistance regulating layer 110BK on the substrate 103BK and a surface layer 111BK on the resistance regulating layer 110BK. The base materials of the resistance regulating layer 110BK include resin or gum materials, such as urethane resin, SBR, EVA, SBS, SEVS, SIS, TPO, EPDM, EPM, NBR, IR, BR, silicone gum and epichlorohydrin gum, etc. Some of the resin-type and gum-type base materials have certain conductivity themselves, but others do not. In the charging step, it is required that the charging member is evenly charged along its longitudinal direction and periphery direction as supplied with a certain current. Therefore, a resistance regulating agent is mixed into the resin-type or gum-type base material, so as to make a uniform resistance in the longitudinal direction and the periphery direction of the charging member. The examples of usable resistance regulating agents include carbon black, carbon fibers, metal oxides, metal powders, solid electrolytes like metal perchlorates, and conductivity imparting agents like surfactants.

Moreover, the base material of the resistance regulating layer 110BK can be a gum or resin material that has a hardness higher then 80° in JIS-A specification, so that the straightness of the charging member 60BK can be maintained with high precision. Therefore, it is possible to more effectively maintain the width of the small gap. Moreover, such resins or gums have good processing properties for easy fabrication of charging members, and can make the resistance regulating layer 110BK have a medium resistance.

Moreover, the resistance regulating layer 110BK preferably comprises a base material and a resistance regulating agent that has an amount from 30 wt % to 90 wt %. As the amount of the resistance regulating agent is lower than 30 wt %, the resistance of the resistance regulating layer 110BK is dominated by the base material, and cannot be suitably adjusted. Meanwhile, it is difficult to evenly disperse the resistance regulating agent in the base material. On the contrary, as the amount of the resistance regulating agent is higher than 90 wt %, the resistance of the resistance regulating layer 110BK is overly lowered, and a uniform resistance is difficult to obtain. Moreover, as a resistance regulating agent that is difficult to disperse because of its properties is used, an addition amount higher than 90 wt % in the base material will particularly make the dispersion difficult.

Furthermore, the surface layer 111BK of the resistor layer 104BK is required to be highly releasable to the toners. Thereby, the toners that are not removed by the cleaning device 63BK and pass the same, can be prevented from being adhered to the charging member as contacting with the latter, and the charging efficiency of the charging member therefore will not be lowered. The surface layer 111BK may comprises a base material and a resistance regulating agent dispersed therein, wherein the base material can be a suitable one selected from the aforementioned resins and gums, especially fluorine resins, silicone resins, acrylate resins, polyamide resins, polyester resins, polyvinylbutyral or polyurethane, etc. The resistance regulating agent in the surface layer 111BK is, for example, an electron-conducting conductive agent selected from carbon black agents and metal oxides, etc., or any other suitable conductive agent. The carbon black agents include Ketchen black, acetylene black and the like, and the metal oxides include indium oxide, tin oxide and the like. Moreover, in order to improve the adhesion strength and the processing properties of the resistance regulating layer 110BK, the surface layer 110BK can be formed from a heat-contraction tube.

The gap tapes that constitute the gap holders 113BK may comprise a material selected from: metal materials like aluminum, iron and nickel, and the oxides thereof; metal alloys like Fe—Ni alloy, stainless steel, Co—Al alloy, Ni-steel, duralumin, monel and inconel; olefin resins like polyethylene (PE) and polypropylene (PP); polyester resins like polyethylene terephthalate (PET) and polybutylene terephthalate (PBT); fluorine resins like polytetrafluoroethylene (PTFE) and the copolymers thereof (e.g., PFA and FEP); and polyamide. Among them, the highly releasable materials, to which toners are difficult to adhere, are particularly preferable. Furthermore, as the gap tapes are formed from a conductive material, it is preferable to form an insulating layer or a semiconductor layer on the gap tapes to insulate the tapes from the image carrier. The insulation treatment is particularly necessary in the cases where the conductive gap tapes contact with the conductive supporter 101BK outside the photosensitive layer 102BK of the image carrier 40BK.

Moreover, the thickness of the surface layer 111BK between the two spacers 105BK is preferably set to 1 μm–20 μm, as mentioned above. As the thickness of the surface layer 111BK is larger than 20 μm, the charging efficiency for the image carrier is lowered. As the thickness is smaller than 1 μm, however, the surface layer 111BK will be worn away after a long-time use, and the toners are easily adhered to the charging member.

Though the resistor layer 104BK between the two spacers 105BK does not contact with the image carrier 40BK, the contamination on the portion of the resistor layer 104BK after repeated use should be considered. Accordingly, it is advantageous to dispose a cleaning member 115BK that contacts with the charging member 60BK for cleaning the same, as shown in FIGS. 4–6. The cleaning member may be supported immobile. Nevertheless, in the cases where the charging member (60BK) is formed as a rotating body, especially a charging roller, as in the charging device 1BK of this embodiment, the cleaning member 105BK is preferably supported so that it can be rotated accompanying with the rotation of the charging member 60BK. A cleaning member 115BK such constituted does not need a driving device and therefore takes a lower cost and a smaller space, while also capable of efficiently cleaning the surface of the charging member 60BK.

The cleaning member 115BK can be simply constituted of a sponge roller. However, when the cleaning member 115BK further includes a brush contacting with the charging member 60BK, as shown in FIGS. 4 and 6, the periphery of the charging member 60BK can be efficiently cleaned. In the illustrated embodiment, the cleaning member 115BK is constituted of a brush roller that includes a brush, and the brush is preferably an electrostatically flocked brush. The electrostatically flocked brush is capable of efficiently scratching the toners from the surface of the charging member, and the scratched toners can be slowly expelled out of the brush.

Moreover, no matter the cleaning member 115BK is constituted of a sponge roller, a brush roller or any other type of cleaning means, the cleaning member 115BK is preferably supported so that it can be moved back and forth, and swung on the charging member 60BK. With this design, the charging member 60BK can be cleaned more efficiently. Referring to FIGS. 4 and 6 again, the cleaning member 115BK contacts with the periphery of the charging member 60BK, and is simultaneously swung in the axial direction thereof, as indicated by the arrow. As the resistance regulating layer 110BK of the charging member 60BK is constituted by a high-hardness material like hard resin, the swung cleaning member 115BK is capable of strongly scratching its periphery surface, and the cleaning efficiency therefore is particularly high.

The charging devices 1Y, 1M and 1C of the second to the fourth image forming means 18Y, 18M and 18C each has the same constitution as the aforementioned charging device 1BK. Moreover, among the constituting elements of each image forming means, at least the charging device and the image carrier charged thereby are integrated into a process cartridge 107BK, as illustrated in FIG. 12. If the process cartridge 107BK is detachably mounted in the image forming apparatus, such as in the housing body of the image forming part 100 illustrated in FIG. 1, the maintainability thereof can be improved.

The specific constitutions of the elements in the image forming means 18BK–18C will be described below, wherein with those of the elements in the first image formation apparatus 18BK are taken as examples.

Referring to FIG. 3, the developing device 61BK includes a developing case 70BK that contains a dry developer therein. The developer may be a one-component developer, or a two-component developer that comprises a magnetic carrier and a non-magnetic toner in the illustrated embodiment. A stirring part 66BK equipped with two screws 68BK, and a developing part 67BK equipped with a developing sleeve 65BK are disposed in the developing case 70BK, wherein the stirring part 66BK is located lower than the developing part 67BK.

The space between the two screws 68BK, except the two end portions thereof, is partitioned by a partition plate 69BK (see FIG. 12), and a toner concentration sensor 71BK (FIG. 3) is mounted in the developing case 70BK. A portion of the developing sleeve 65BK is exposed by an aperture of the developing case 70BK, and is located opposite to the image carrier 40BK, while a doctor blade 73BK is disposed with its tip near the developing sleeve 65BK. The smallest distance between the doctor blade 73BK and the developing sleeve 65BK is set to 500 μm, for example.

The developing sleeve 65BK is constituted of a non-magnetic body, and is driven rotating clockwise as shown in FIG. 3. The diameter of the developing sleeve 65BK is, for example, 18 mm. The periphery surface of the developing sleeve 65BK has been treated with sandblast or formed with a plurality of trenches from one to several millimeters in depth, and has a roughness "RZ" ranging from 10 μm to 30 μm. A magnet 72BK is disposed and fixed in the developing sleeve 65BK, having five magnetic poles $N_1$, $S_1$, $N_2$, $S_2$ and $S_3$ (not shown) that are arranged sequentially along the rotating direction of the developing sleeve 65BK starting from the location near the doctor blade 73BK. The magnet 72BK is disposed with the magnetic pole $S_1$ thereof facing the image carrier 40BK.

The two-component developer in the developing case 70BK is stirred with the two screws 68BK and circularly transported at the same time, and is supplied to the developing sleeve 65BK. The developer supplied to the developing sleeve 65BK is drawn to the magnet 72BK and carried thereon, and a magnetic brush therefore is formed on the developing sleeve 65BK. Accompanying with the rotation of the developing sleeve 65BK, the magnetic brush is nap-cut by the doctor blade 73BK to reach a medium amount, and the removed developer will drop back to the stirring part 66BK. The toner contained in the developer, which is carried on and transported by the developing sleeve 65BK, is then transferred to the electrostatic latent image formed on the image carrier 40BK with the effect of a developing bias voltage applied to the developing sleeve 65BK. Thus, the electrostatic latent image is visualized on the image carrier 40BK. After that, the residual toner on the developing sleeve 65BK drops back to the stirring part 66BK at a location where the magnetic force of the magnet 72BK does not reach. Moreover, when the toner concentration in the stirring part 66BK becomes low after repeated use, the toner deficiency can be detected by the toner concentration sensor 71BK, and some toner is supplied to the stirring part 66BK.

Moreover, in the development stage of the illustrated embodiment, the linear speeds of the image carrier 40BK and the developing sleeve 65BK are 200 mm/s and 240 mm/s, respectively, while the diameters of the image carrier 40BK and the developing sleeve 65BK are 50 mm and 18 mm, respectively. The quantity of electricity of the toner on the developing sleeve 65BK is preferably −10–−30 μC/g, and the development gap between the image carrier 40BK and the developing sleeve 65BK can be set to 0.4 mm–0.8 mm as before. It is possible to improve the efficiency of development by decreasing the width of the development gap.

Moreover, in the image forming apparatus of this embodiment, the thickness of the photosensitive layer 102BK is 30 μm, the beam spot diameter of the optical system is 50×60 μm, and the light power is 0.47 mW. In addition, the electrical potential $V_0$ of the photosensitive layer 102BK of the image carrier 40BK before the exposure is −700V, and that (V) after the exposure is −120V. The developing bias voltage is −470V, which means that the developing potential is 350V in the development process.

The cleaning device 63BK used for the image carrier 40BK includes a cleaning blade 75BK with its tip pressed on the surface of the photosensitive layer 102BK of the image carrier 40BK, the cleaning blade 75BK being made from a material such as polyurethane gum. The cleaning device 63BK may further incorporate a brush that has a periphery contacting with the surface of the image carrier, such as a conductive fur brush 76BK that is rotated freely in the arrow direction in this embodiment, for improving the cleaning effect. Moreover, the fur brush 76BK is equipped with a metallic electric-field roller 77BK that is used to apply a bias to the fur brush 76BK and can be rotated freely in the arrow direction. A scraper 78BK is disposed pressed on the electric field roller 77BK with its tip, and a recovering screw 79BK is disposed for recovering the removed toner. Meanwhile, the fur brush 76BK is rotated in a counter direction with respect to the image carrier 40BK, so that the residual toner on the image carrier 40BK can be removed. The toner adhered to the fur brush 76BK is then removed by the electric-field roller 77BK, which is rotated in the counter direction with respect to the fur brush 76BK, and is applied with a bias voltage. Thereafter, the toner adhered to electric-field roller 77BK is removed by the scraper 78BK. The toner recovered by the cleaning device 63BK is moved to one side of the cleaning device 63BK with the recovering screw 79BK, and then dropped back to the developing device 61BK for recycling via a toner recycling device 80BK described later.

Figure 13:
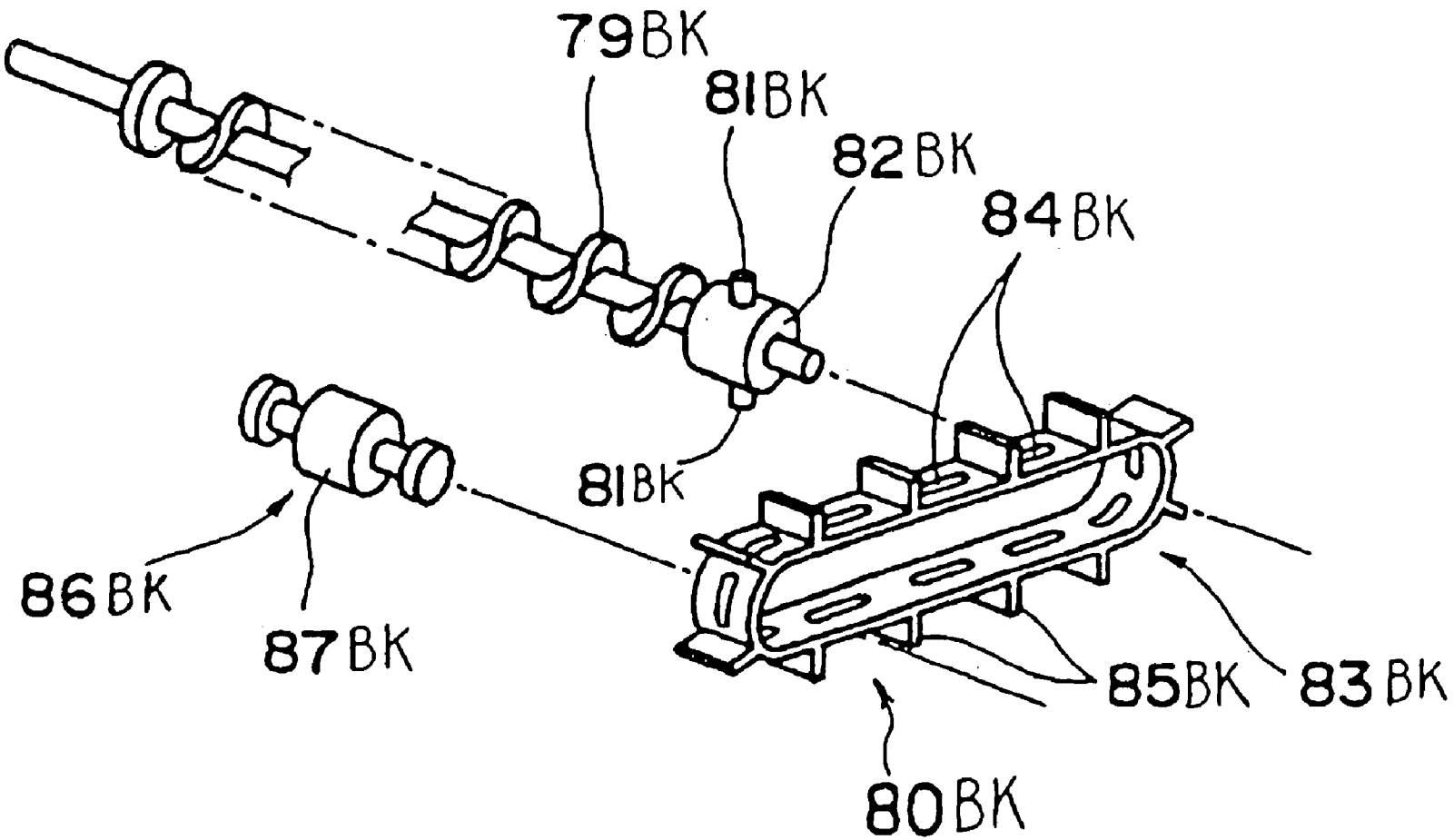
FIG. 13 illustrates an exploded perspective view of a toner recycle device.

The toner recycling device 80BK is illustrated in FIGS. 12–13. As shown in FIG. 13, a roller part 82BK having pins 81BK thereon is disposed on the recovering screw 79BK of the cleaning device 63BK (see FIG. 3) used for the image carrier 40BK. Meanwhile, one side of a belt-like recovered-toner transporting member 83BK, which is formed with plural long holes 84BK invaded by the pins 81BK and plural blades 85BK disposed with a certain interval between each other, is hung on the roller part 82BK. The other side of the recovered-toner transporting member 83BK is hung on a roller part 87BK of a rotation shaft 86BK.

The recovered-toner transporting member 83BK is disposed in a transporting passage case 88BK illustrated in FIG. 12 accompanying with the rotation shaft 86BK. The transporting passage case 88BK is integrated with a cartridge case 89BK, and one of the two screws 68BK of the developing device 61BK extends into an end portion of the transporting passage case 88BK near the developing device 61BK. In the recycling operation, the toner recovered by the cleaning device 63BK is transported through the transporting passage case 88BK via the transportation of the recovered-toner transporting member 83BK, which is driven by the rotation of the recovering screw 79BK that is driven by an external force. The toner passing the transporting passage case 88BK is then transported into the developing device 61BK via the rotation of the screw 68BK. Thereafter, as mentioned above, the recovered toner is stirred accompanying with the original developer in the developing device 61BK by the two screws 68BK and circularly transported simultaneously, and the mixed developer is supplied to the developing sleeve 65BK and then nap-cut by the doctor blade 73BK. Subsequently, the toner is transferred to the image carrier 40BK for developing a new electrostatic latent image thereon.

The toner is constituted by matrix particles that comprise a binder resin and other materials like electrostatic-charge controlling agents or releasing agents contained in the binder resin, while some additives can be further added into the toner. The binder resin used in the toner can be one well known in the prior art, such as polystyrene, styrene-butadiene copolymer, styrene-vinyl chloride copolymer, styrene-acrylate ester copolymer, styrene-methacrylate ester copolymer, acrylate resin, polyester resin, epoxy resin, polyol resin, rosin-modified maleate resin, phenol resin, low-molecular-weight polyethylene, low-molecular-weight polypropylene, ionomer resin, polyurethane resin, ketone resin, ethylene-ethyl acrylate copolymer, polybutyral, or silicone resin. Each of the binder resins can be used alone or in combination with one or more among the others, wherein polyester resin and polyol resin are particularly preferable.

The polyester resin used as a binder resin can be of any type, while the one formed by the reaction of the monomer species of ①, ② and ③ is particularly preferable.

①: at least one compound selected from dibasic carboxylic acids and their lower alkylesters and anhydrides;

②: a diol component expressed by formula (I)

(I)

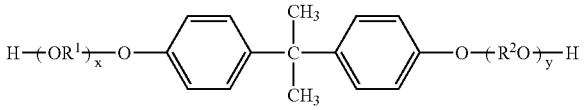

wherein $R^1$ and $R^2$ are the same or different, and each can be an alkylene group having 2–4 carbon atoms; x and y are the numbers of repeating units, x, y≧1, and x+y=2–16.

③: at least one compound selected from tribasic or polybasic carboxylic acids and their lower alkylesters and anhydrides, and trihydric or polyhydric alcohols.

The examples of the dibasic carboxylic acids and their lower alkylesters and anhydrides include: terephthalic acid, isophthalic acid, sebacic acid, isodecylsuccinic acid, maleic acid, fumaric acid and their monomethyl esters, monoethyl esters, dimethyl esters and diethyl esters, and phthalic acid anhydride and maleic acid anhydride. Among them, terephthalic acid, isophthalic acid and their dimethyl esters are particularly preferable in view of their blocking resistance and costs. The species of the dibasic carboxylic acids and their lower alkylesters and anhydrides greatly affect the fixability and the blocking resistance of the toner. For example, as more terephthalic acid, isophthalic acid or the like of aromatic type is used, the blocking resistance of toner can be improved in consideration of the condensation degree, but the fixability is adversely lowered. On the contrary, as more sebacic acid, isodecylsuccnic acid, maleic acid or fumaric acid is used, the fixability can be improved, but the blocking resistance is adversely lowered. Therefore, the dicarboxylic acids should be properly selected according to the species and the percentages of the other monomers and the condensation degree, and be used alone or in combination.

The examples of the diol component of formula (I) in item ② include: polyoxypropylene-(n)-polyoxyethylene-(n')-2,2-bis(4-hydroxyphenyl)propane, polyoxypropylene-(n)-2,2-bis(4-hydroxyphenyl)propane, and polyoxyethylene-(n)-2,2-bis(4-hydroxyphenyl)propane, wherein the polyoxypropylene-(n)-2,2-bis(4-hydroxyphenyl)propane compounds with "n" values ranging from 2.1 to 2.5 (2.1≦n≦2.5) and the polyoxyethylene-(n)-2,2-bis(4-hydroxyphenyl)propane compounds with "n" values ranging from 2.0 to 2.5 (2.0≦n≦2.5) are particularly preferable. Such diol components are capable of raising the glass transition temperature of the polyester resin, and the reaction control is easier thereby.

Besides, the diol components may be aliphatic diols, including ethylene glycol, diethylene glycol, 1,2-butadiol, 1,3-butadiol, 1,4-butadiol, neo-pentylglycol and propylene glycol.

The examples of the tribasic or polybasic carboxylic acids and their lower alkylesters and anhydrides in item ③ include: 1,2,4-benzenetricarboxylic acid (trimellitic acid), 1,3,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexenetricarboxylic acid, 1,3-dicarboxyl-2-methyl-2-methylenecarboxypropane, tetra(methylenecarboxy)methane, 1,2,7,8-octanetetracarboxylic acid, enpol trimer acid, and their monomethyl esters, monoethyl esters, dimethyl esters and diethyl esters, etc.

The examples of the trihydric or polyhydric alcohols in item ③ include: sorbitol, 1,2,3,6-hexanetetrol, 1,4-sorbitane, pentaerythritol, dipentaerythritol, tripentaerythritol, saccharose, 1,2,4-butanetriol, 1,2,5-pentatriol, glycerol, diglycerol, 2-methylpropanetriol, 2-methyl-1,2,4-butanetriol, trimethylolethane, trimethylolpropane and 1,3,5-trihydroxymethylbenzene, etc.

The total molar percentage of the tri- or higher valent monomer(s) is suitably 1–30 mol % relative to the entire monomer composition. As the percentage is lower than 1 mol %, the blocking resistance and the durability of the toner are both lowered; as the percentage is higher than 30 mol %, the fixability of the toner is lowered.

Among the tri- or higher valent monomers mentioned above, the compounds of benzenetricarboxylic acid series, including benzenetricarboxylic acids and their anhydrides and esters, are particularly preferable, since they are capable of improving the fixability and the blocking resistance simultaneously.

On the other hand, the polyol resin used as the binder resin can be of any type, while the one obtained from the reaction of ① epoxy resin, ② an alkylene oxide adduct or a glycidyl ether of dihydric phenol, ③ a compound that has an active hydrogen atom capable of reacting with an epoxy group, and ④ a compound that has two or more active hydrogen atoms capable of reacting with epoxy groups is particularly preferable. The epoxy resin ① is preferably obtained from the reaction of epichlorohydrin and a bisphenol compound like bisphenol A or bisphenol F. The epoxy resin that comprises at least two kinds of bisphenol A epoxy resin having different number average molecular weights are particularly preferable in view of the fixing characteristics or the photographic gloss. The number average molecular weight of the low-molecular-weigh component is 360–2000, and that of the high-molecular weight component is 3000–10000, while the percentages of the low-molecular-weigh component and the high-molecular-weigh one are preferably 20–50 wt % and 5–40 wt %, respectively. As the amount of the low-molecular-weight component is overly large to make a low average molecular weight under 360, the toner is too glossy and the storage stability may be lowered. As the amount of the high-molecular-weight component is overly large to make a high average molecular weight above 10000, the toner is insufficiently glossy, and the fixability may be lowered.

Moreover, the examples of the alkylene oxide adduct of dihydric phenol of ② include the reaction products of ethylene oxide, propylene oxide, butylene oxide or the combinations thereof and a bisphenol compound like bisphenol A or bisphenol F. Each of the adducts may further be attached with a glycidyl group by using epichlorohydrin or β-methylepichlorohydrin. Particularly, the diglycidylether expressed by formula (2) below, which is derived from an alkylene oxide adduct of bisphenol A, is more preferable.

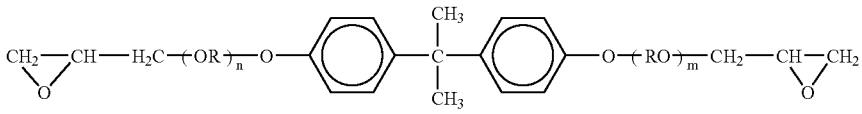

(2)

wherein R represents $—CH_2—CH_2—$, $—CH_2—CH(CH_3)—$ or $—CH_2—CH_2—CH_2—$ group, and n and m are the numbers of repeating units, n, m≧1, and n+m=2–6.

Moreover, the weight percentage of the alkylene oxide adduct or glycidyl ether of dihydric phenol is preferably 10–40 wt % relative to the total polyol resin. As the percentage is lower than 10 wt %, some problems are caused including the increase of curl degree. Moreover, as the value of "n+m" is equal to or larger than 7, the toners are overly glossy and the storage stability may be lowered.

The examples of the compound ③ that has an active hydrogen atom capable of reacting with an epoxy group include monohydric phenol compounds, secondary amine compounds and carboxylic acids. The examples of the monohydric phenol compounds include phenol, cresol, isopropylphenol, aminophenol, nonylphenol, dodecylphenol, xylenol, p-cumylphenol. The examples of the secondary amine compounds include diethylamine, dipropylamine, dibutylamine, N-methyl(ethyl)piperazine and piperidine. The examples of the carboxylic acids include propionic acid and caproic acid.

The examples of the compound ④ that has two or more active hydrogen atoms capable of reacting with epoxy groups include dihydric phenol compounds, polyhydric phenol compounds and polybasic carboxylic acids, etc. The examples of the dihydric phenol compounds include bisphenol compounds like bisphenol A and bisphenol F, etc. The examples of the polyhydric phenol compounds include ortho-cresol novolak, phenol novolak, tris(4-hydroxyphenyl)methane and 1-[α-methyl-α-(4-hydroxyphenyl) ethyl] benzene. The example of polybasic carboxylic acids include malonic acid, succinic acid, glutaric acid, adipic acid, maleic acid, fumaric acid, phthalic acid, terephthalic acid, trimellitic acid and mellitic acid anhydride.

Moreover, the polyester resins or polyol resins are preferably of non-crosslinking type or weakly crosslinking type (insoluble component under 5 wt % in THF), since the transparency or gloss will be insufficient as the crosslinking density is high. In addition, the methods for preparing the binder resin are not particularly restricted, including bulk polymerization, solution polymerization, emulsion polymerization and suspension polymerization.

On the other hand, the colorant that can be used in the toner can be any dye or pigment well known in the prior art. The examples of yellow colorants include Naphthol Yellow S, Hansa Yellow (10G, 5G and G), cadmium yellow, yellow iron oxide, yellow ocher, chrome yellow, titanium yellow, polyazo yellow, oil yellow, Hansa Yellow (GR, A, RN and R), Pigment Yellow L, Benzidine Yellow (G and GR), Permanent Yellow (NCG), Vulcan Fast Yellow (5G and R), tartrazine lake, quinoline yellow lake, Anthrazane Yellow BGL, benzimidazolone yellow and iso-indolinone yellow, etc.

The examples of red colorants include Indian Red, lead oxide, red lead, cadmium red, cadmium-mercury red, antimony red, Permanent Red 4R, para-nitraniline red, Fire Red, para-chloro-ortho-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red (F5R and FBB), Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rodamine Lake B, Rodamine Lake Y, alizarin lake, Thioindigo Red B, Thioindigo Maroon, oil red, quinacridon red, pyrazolone red, polyazo red, chromium vermilion, benzidine orange, perinone orange and oil orange, etc.

The examples of cyan colorants include cobalt blue, Cerulean Blue, alkali blue lake, peacock blue lake, Victoria Blue Lake, metal-free phthalocyanine blue, phthalocyanine blue, Fast Sky-Blue, Indanthrene Blue (RS and BC), indigo, Prussian Blue, ultramarine blue, anthraquinone blue, Fast Violet B, methyl violet lake, cobalt violet, manganese violet, dioxane violet, anthraquinone violet, chromium green, zinc green, chromium oxide, Viridian, emerald green, Pigment Green B, Naphthol Green B, green gold, acid green lake, Malachite Green Lake, phthalocyanine green and anthraquinone green, etc.

The examples of black colorants include carbon black, oil-furnace black, channel black, lamp black, acetylene black, azine-type black pigments like aniline black, metal-salt azo pigments, metal oxides and composite metal oxides, etc. Other colorants include titania, zinc oxide, lithopone, nigrosin dyes and iron black, etc. These colorants can be used alone or in combination, with an amount of 1–30 weight parts, preferably 3–20 weight parts, relative to 100 weight parts of the binder resin.

Furthermore, other materials like electrostatic-charge controlling agents and releasing agents may also be added into the toners as required.

The electrostatic-charge controlling agents can be those well known in the prior art. The examples include nigrosin dyes, chromium-containing complexes and quaternary ammonium salts, which are selected according to the polarity of the toner particles. In the cases of color toners, particularly, colorless or light-colored electrostatic-charge controlling agents that do not affect the color of the toner, such as metal salicylate salts and metal salts of salicylic acid derivatives (e.g., BONTRON E84 produced by ORIENT CORPORATION), are more preferable. Meanwhile, the aforementioned electrostatic-charge controlling agents can be used alone or in combination, with an amount of 0.5–8 weight parts, preferably 1–5 weight parts, relative to 100 weight parts of the binder resin.

Furthermore, releasing agents can be added in a toner to improve the releasability of the toner to the fixing member in the fixing process and simultaneously improve the fixability of the same. The usable releasing agents can be those well known in the prior art. The examples include: low-molecular-weight polyolefin waxes like low-molecular-weight polyethylene and low-molecular-weight polypropylene; synthetic hydrocarbon waxes like Fischer-Tropsch wax; natural waxes like bee's wax, carnauba wax, candelilla wax, Rice wax and Montan wax; petroleum waxes like paraffin wax and micro-crystalline wax; higher aliphatic acids like stearic acid, palmitic acid and myristic acid, and the metal salts thereof; amides of higher aliphatic acids; and various modified waxes, etc. Each of the aforementioned releasing agents can be used alone or in combination with one or more among the others, wherein the carnauba wax is particularly useful for achieving good releasability. In addition, the amount of the releasing agents is 1–15 weight parts, preferably 2–10 weight parts, relative to 100 weight parts of the binder resin. As the amount is smaller than 1 weight part, the anti-offset effect is insufficient; as the amount is larger than 15 weight parts, the transferability and the durability of the toner are lowered.

The toner may further contain a magnetic material and be used as a magnetic toner. The specific examples of the magnetic material include: ferrous oxides like magnetite, hematite and ferrite; metallic materials like cobalt and nickel; metal alloys formed from one or more magnetic metal material(s) mentioned above and one or more other metal material(s) like aluminum, copper, lead, magnesium, tin, zinc, antimony, beryllium, bismuth, cadmium, calcium, manganese, selenium, titanium, tungsten and vanadium; and the combinations thereof. The average grain size of the magnetic material is preferably 0.1–2 μm, and the amount of the same is 20–200 weight parts, preferably 40–150 weight parts, relative to 100 weight parts of the binder resin.

An example of the fabricating process of a toner is described below.

① sufficiently mixing a binder resin and a colorant mentioned above and, as required, a electrostatic-charge controlling agent, a releasing agent and a magnetic material with a mixer such as a Hanschel mixer;

② sufficiently kneading the constituting materials with a batch-type twin-screw extruder of two-roller type, Banbury mixer type or continuous type, such as a KTK Twin-Screw Extruder manufactured by KOBE STEEL, Ltd., a TEM Twin-Screw Extruder by TOSHIBA MACHINE Co., Ltd., a twin-screw extruder by KCK Corporation, a PCM Twin-Screw Extruder by IKEGAI CORPORATION, a KEX Twin-Screw Extruder by KURIMOTO, Ltd., or with a single-screw kneader of continuous type, such as a thermal kneader like the Ko-Kneader manufactured by BUSS Corporation.

③ after the kneaded mixture is cooled, coarsely grinding the mixture by using a hammer mill, and further pulverizing the mixture with a pulverizer using jet airflow or a mechanical grinding machine. Then, sorting the obtained particles based on required particle sizes with a sorter using turning airflow or one using Coanda effect, so as to obtain matrix particles.

Furthermore, other methods like polymerization method or capsule method can also be used, which are briefly described below.

The steps of an exemplary polymerization method are as follows:

① forming particles with polymerizable monomers and, as required, a polymerization initiator and a colorant in an aqueous dispersion;

② sorting the particles formed from the monomer composition based on a suitable particle size;

③ polymerizing the monomers in the sorted monomer composition particles having diameters within a required range; and ④ removing the dispersing agent with a suitable treatment, and then filtering, washing and drying the particles to obtain matrix particles.

The steps of an exemplary capsule method are as follows:

① kneading a resin and, as required, a colorant with a kneader to obtain a melted toner core material;

② placing the toner core material into water and vigorously stirring it into fine particles;

③ placing the fine particles of core material into a shell material solution, and then stirring the solution and simultaneously adding a poor solvent for covering the surface of the core material with a layer of shell material, i.e., for encapsulating the fine particles of core material; and ④ filtering and drying the capsules obtained above to obtain matrix particles.

Subsequently, the matrix particles and an additive are mixed with a mixer like a Hanschel mixer manufactured by MITSUI MIIKE MACHINERY Co., Ltd., the Mechano Fusion System by Hosokawa Micron Group or a Mechano Mill by Okada Seiko Co., Ltd. If required, the mixture is further screened with a sieve having apertures smaller than 150 μm for removing aggregations and coarse particles.

The additive used here can be one well known in the prior art. The examples include: the oxides or the composite oxides of Si, Ti, Al, Mg, Ca, Sr, Ba, In, Ga, Ni, Mn, W, Fe, Co, Zn, Cr, Mo, Cu, Ag, V and Zr, wherein silica, titania and alumina, which are the oxides of silicon, titanium and aluminum, respectively, are particularly preferable. The amount of the additive is preferably 0.6–4.0 weight parts, more preferably 1.0–3.6, relative to 100 weight parts of the matrix particles. As the addition amount is smaller than 0.6 weight part, the fluidity, the chargability, the transferrability and the thermal stability of the toner are insufficient, and ground stains and toner scattering may also be caused. As the addition amount is larger than 4.0 weight parts, the fluidity is improved, but the photosensitive body is insufficiently cleaned because of some reasons like chatter and the burr of the blades, or the additive may escape from the toner and form films on some elements including the photosensitive body. Meanwhile, the durability of the cleaning blades or photosensitive body is lowered, and the fixability of the toner is deteriorated.

The percentage of the additive can be measured with various methods, while the fluorescent X-ray analysis method is generally used. In the method, a series of toners with different additive concentrations are measured with fluorescent X-ray analysis for making a calibration curve, which is used to derive the additive concentration in an analyzed example. Moreover, the additive is preferably subjected to a surface treatment in consideration of hydrophobicity, fluidity improvement and electrostatic-charge control.

The treating agents that can be used in the surface treatment are preferably organic silane compounds. The examples include: alkylchlorosilane compounds like methyltrichlorosilane, octyltrichlorosilane and dimethyldichlorosilane; alkylmethoxysilane compounds like dimethyldimethoxysilane and octyltrimethoxysilane; hexamethyldisilazane and silicone oil, etc. In addition, the surface treatment can be done by dipping the additive in a solution containing an organic silane compound and then drying it, or by spraying a solution containing the organic silane compound onto the additive and then drying it, or in any other suitable way.

Moreover, the average primary particle size of the additive added into the matrix particles is preferably 0.002–0.2 μm, particularly preferably 0.005–0.05 μm, so as to achieve a sufficient fluidity. If the average primary particle size of the additive is smaller than 0.002 μm, the additive particles are easily embedded in the surfaces of the matrix particles to cause aggregations, and the fluidity is also insufficient. Meanwhile, the photosensitive body and other elements are easily subjected to filming contamination, especially under high-temperature and high-humidity conditions. Furthermore, as the average primary particle size of the additive is smaller than 0.002 μm, aggregations between the additive particles are also easily caused, and the fluidity therefore is insufficient. On the other hand, as the average primary particle size is larger than 0.2 μm, the fluidity of the toner is lowered so that the chargability is insufficient, and ground stains and toner scattering are easily caused. Moreover, as the average primary particle size is larger than 0.1 μm, the surface of the photosensitive body is easily damaged, and some problems like filming phenomenon are easily caused. In addition, the particle sizes of the additive are measured by using a tunneling electron microscope (TEM).

Except the aforementioned additives, other additives may be further added into the toner. The examples include some lubricants like Teflon™, zinc stearate and polyvinylidene fluoride, etc.; some abrasives like cerium oxide, silicon carbide and strontium titanate, etc.; and some conductivity imparting materials like zinc oxide, antimony oxide and tin oxide, etc.

Moreover, the weight average particle size of the toner is preferably 4–9 μm, and more preferably 5–8 μm. As the weight average particle size is smaller than 4 μm, ground stains and toner scattering easily occur in the development process, and the fluidity is lowered so that the toner supply or cleaning is hindered. Moreover, as the weight average particle size is larger than 8 μm, some problem like image dusting or resolution lowering may be caused, especially in the cases of color image formation.

The usable toner may be a one-component toner or a two-component toner, wherein the latter is used as a two-component developer mixed with a carrier. The carrier can be any one well-known in the prior art, and the examples include glass beads, and magnetic powders like iron powder, ferrite powder and nickel powder, while it is particularly preferable to have the surface of the carrier covered with a resin. The examples of the usable resins include polyfluorocarbon, polyvinyl chloride, polyvinylidene chloride, phenol resin, polyvinylacetal, acrylate resin and silicone resin, etc. Moreover, the resin film can be formed on the carrier by coating the surface of the carrier with the resin via a spraying or dipping method, as in the prior art. The addition amount of the resin is preferably 1–10 weight parts relative to 100 weight parts of the carrier, and the thickness of the resin film is preferably 0.02–2 μm, more preferably 0.05–1 μm, and still more preferably 0.1–0.6 μm. As the thickness of the resin film is overly large, the fluidity of the carrier and the toner tends to be lower. On the contrary, as the thickness is overly small, the resin film is easily worn away with time. Moreover, the average particle size of the carrier is 10–100 μm, and preferably 30–60 μm. In addition, the mixing ratio of the toner to the carrier is suitably 0.5–7.0:100 as measured in weight.

The fabrication examples of the toners, the carriers and the developers, respectively, are described as follows, while the examples are not intended to restrict the scope of this invention. Moreover, it is noted that the term "part" in the following descriptions means "weight part".

<Fabrication Example of Toner>

| | |
|---|---|
| Binder Resin: | |
| Polyester resin (synthesized with terephthalic acid, fumaric acid, polyoxypropylene-(2,2)-2,2-bis(4-hydroxyphenyl)propane and trimellitic acid; Tg = 62° C.; softening point: 106° C.) | 100 parts |
| Colorants: | |
| Pigment used in yellow toner (diazo yellow pigment: C.I. Pigment Yellow 17) | 7.0 parts |
| Pigment used in magenta toner (quinacridone magenta pigment: C.I. Pigment Red 122) | 7.0 parts |
| Pigment used in cyan toner (copper phthalocyanine blue pigment: C.I. Pigment Blue 15:3) | 3.5 parts |
| Pigment used in black toner (carbon black: C.I. Pigment Black 7) | 6.0 parts |
| Electrostatic-charge controlling agent Zinc salt of salicylic acid derivative | 2.5 parts |
| Releasing agent Carnauba wax (melting point: 85° C.) | 5 parts |

The above raw materials are mixed by using a Hanschel mixer, and then melt-kneaded by using a twin-screw kneader under 110° C. Next, the resulting mixture is cooled with water, and after cooling, the kneaded mixture is coarsely ground with a cutter mill, pulverized with a pulverizer using jet airflow, and then sorted with a pneumatic classifier. Thereby, matrix particles are obtained.

Moreover, 100 parts of the aforementioned matrix particles and two additives:

| | |
|---|---|
| silica (with surface treatment of hexamethyldisilazane, average primary particle size: 0.01 μm) | 0.8 part |
| titania (with surface treatment of isobutyltrimethoxysilane, average primary particle size: 0.015 μm) | 1.0 part |

are mixed with a Hanschel mixer, and then pneumatically screened with a sieve having apertures of 100 μm. Thereby, the toner of the fabrication example is obtained with a weight average particle size of 6.8 μm.

The particle size distribution of the toner can be measured with various methods, while a Coulter Multisizer is used in this example. In detail, a Coulter Multisizer IIe manufactured by Coulter Corporation is used as a measuring instrument, and is linked with a personal computer via an interface manufactured by Nikkaki Corporation for outputting number distributions and volume distributions of the particles. The electrolyte solution used for the measurement is a NaCl solution of 1 wt % prepared with primary sodium chloride, and the steps of the measurement are described as follows. A surfactant, which serves as a dispersing agent and is preferably an alkylbenzene-sulfonate salt, is added into 100–150 milliliters of the aforementioned electrolyte solution with an amount of 0.1–5 ml. A toner sample of 2–20 mg is then added into the electrolyte solution and dispersed with a supersonic disperser for 1–3 minutes. Moreover, 100–200 milliliters of the electrolyte solution is loaded into another beaker, and the above dispersed solution of the sample is added into the beaker until a predetermined concentration is obtained. The resulting dispersion is then measured by using a Coulter Multisizer IIe with apertures of 100 μm for obtaining the statistics of 50,000 particles.

<Fabrication Example of Carrier>

| | |
|---|---|
| Core material | |
| Cu—Zn ferrite particles (weight average particle size: 45 μm) | 5000 parts |
| Coating materials | |
| Toluene | 450 parts |
| Silicone resin SR2400 (produced by Dow Corning Toray Silicone Co., Ltd., with a non-volatile component of 50%) | 450 parts |
| Aminosilane SH6020 (produced by Dow Corning Toray Silicone Co., Ltd.) | 10 parts |
| Carbon black | 10 parts |

A coating solution is prepared by stirring and dispersing the coating materials for 10 minutes. Then, the coating solution and the core material are loaded into a coating apparatus, in which a coating operation is performed accompanying with formation of a vortex that is generated with a rotating bottom plate desk and stirring blades disposed in a flowing bed. Thereby, the core material is coated with the coating solution. Subsequently, the carrier obtained as above is sintered by using an electric oven under 250° C. for 2 hours, and the carrier of this fabrication example is obtained with a film of 0.5 μm thereon.

<Fabrication Example of Developer>

In this example, a developer is obtained by mixing 5 parts of the toner fabricated as above and 95 parts of the carrier fabricated as above with a Turbler mixer.

As mentioned above, the above image forming apparatus can work with the charging devices and the image carriers that are charged by the charging devices as described above. However, since the resistor layer of the charging member between the two spacers is proximal to the surface of the image carrier, the discharge of the charging member greatly affects the photosensitive layer of the image carrier. Therefore, the photosensitive layer is progressively deteriorated, and the surface thereof is easily worn away. Particularly, as a voltage constituted by a DC voltage and an AC voltage superimposed thereon is applied to the charging member, the photosensitive layer is more easily worn away because of the effects of the frequency or inter-peak voltage difference of the composite voltage. When the photosensitive layer is worn away, a high-quality image surely cannot be formed. Moreover, as the thickness of the photosensitive layer is not uniform, the discharge current will concentrate on the uneven parts, and the surface of the photosensitive layer is locally worn away. A feasible method for solving the problem is to increase the thickness of the photosensitive layer, so that the affect of the damaged portions on the surface thereof can be reduced. Nevertheless, as the thickness of the photosensitive layer is increased, the photosensitive layer is easily affected by environment changes, and thickness variations of the same may be caused. Therefore, the toner concentration of the image will be uneven.

In view of this, the image carrier 40BK of the image forming apparatus of this embodiment includes a surface layer that contains a filler. For example, the filler is contained in such a way that the surface layer is not easily worn away with time. Such a surface layer is not easily worn away by discharge, even if a voltage constituted by a DC voltage and an AC voltage superimposed thereon is applied to the charging member. Therefore, it is possible to form high-quality images for a long time. The specific constitution of the image carrier is described below.

Figure 14:
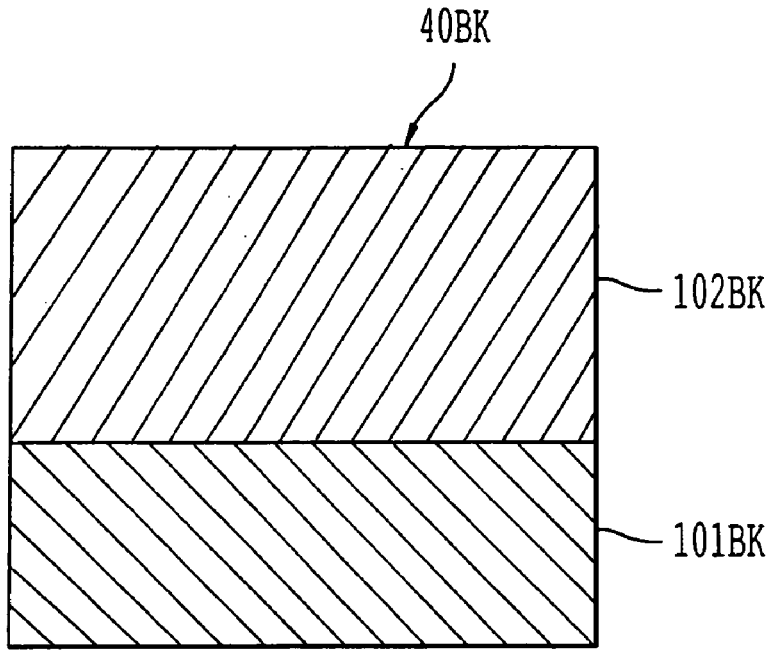
FIG. 14 illustrates a cross-sectional view of one type of image carrier.
Figure 15:
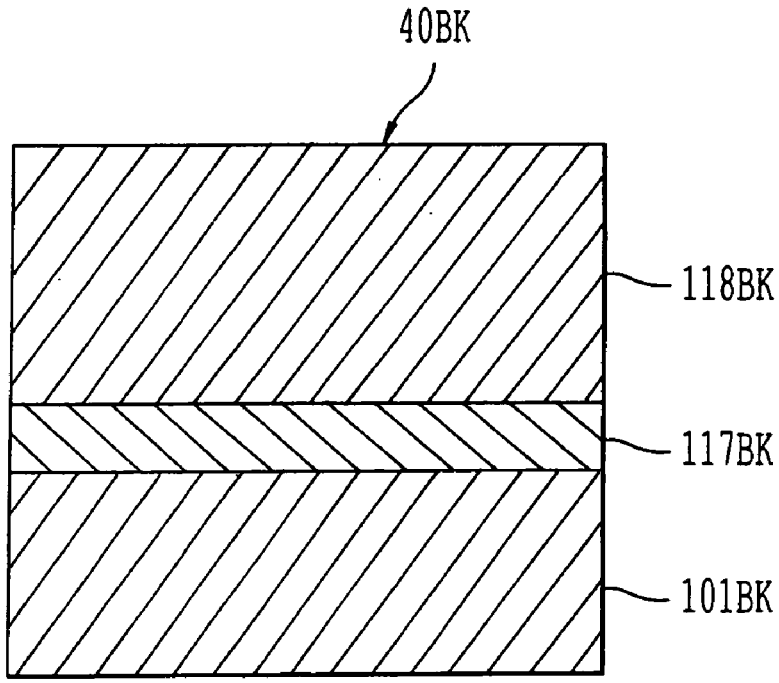
FIG. 15 illustrates a cross-sectional view of another type of image carrier.
Figure 16:
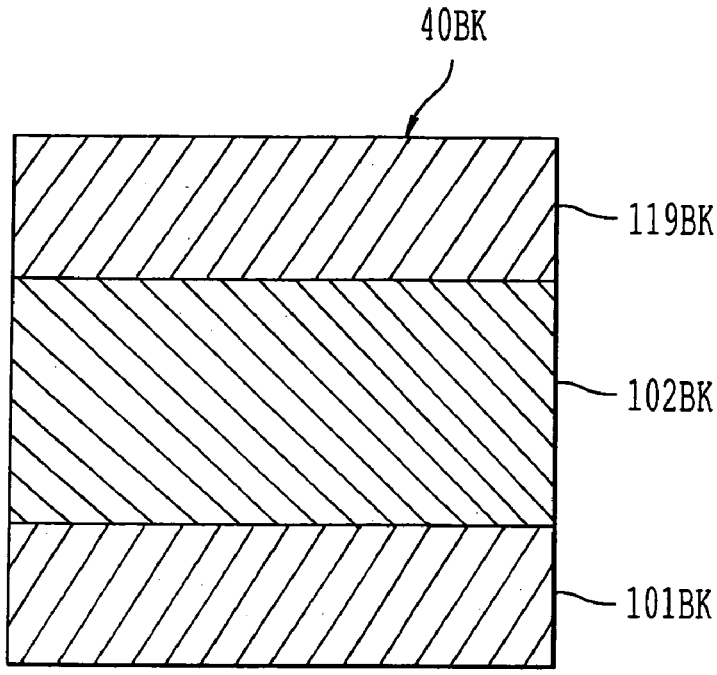
FIG. 16 illustrates a cross-sectional view of still another type of image carrier.
Figure 17:
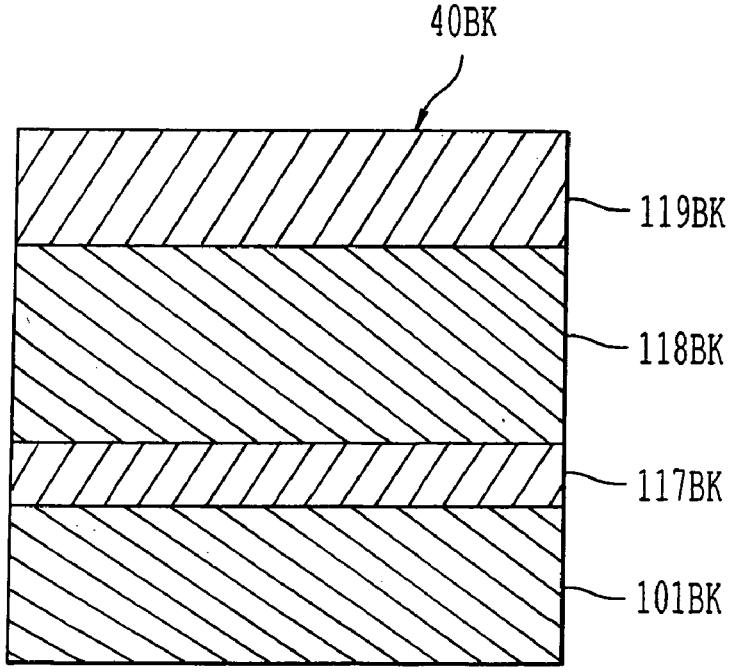
FIG. 17 illustrates a cross-sectional view of still another type of image carrier.

FIGS. 14–17 schematically illustrate cross-sectional views of the image carriers 40BK in different modes, wherein each image carrier is constituted of an electrophotographic photosensitive body. The image carrier 40BK in FIG. 14 is constituted by a conductive supporting body 101BK and a single-layer photosensitive layer 102BK thereon, wherein the latter is mainly composed of a charge generating material and a charge transferring material. In this case, fillers are contained at least in the surface of the photosensitive layer. The image carrier 40BK in FIG. 15 is constituted by a conductive supporting body 101BK, and a charge generating layer 117BK based on a charge generating material and a charge transferring layer 118BK based on a charge transferring material that ate sequentially disposed on the former. In this case, fillers are contained at least in the surface of the charge transferring layer 118BK. The image carrier 40BK in FIG. 16 is constituted by a conductive supporting body 101BK and a single-layer photosensitive layer 102BK disposed thereon, wherein the latter is mainly composed of a charge generating material and a charge transferring material. Moreover, a filler-enforced charge transferring layer 119BK that contains fillers is disposed on the surface of the photosensitive layer 102BK. The image carrier 40BK in FIG. 17 is constituted by a conductive supporting body 101BK, and a charge generating layer 117BK based on a charge generating material and a charge transferring layer 118BK based on a charge transferring material that are sequentially disposed on the former. Moreover, a filler-enforced charge transferring layer 119BK that contains fillers is disposed on the surface of the charge transferring layer 118BK.

The conductive supporting body 101BK has a volume resistance lower than $10^{10}$ Ω·m. The conductive supporting body 101BK may be a film-like or cylindrical plastic or paper that is covered with metal or metal oxide by using evaporation or sputtering, or be a tube made from a plate or the like composed of aluminum, aluminum alloy, nickel or stainless steel. In the former case, the examples of the metal include aluminum, nickel, chromium, nichrome, copper, gold, silver and platinum, etc., and the examples of the metal oxide include tin oxide and indium oxide, etc. In the latter case, the plate is firstly formed into a raw tube with a method such as extrusion or draw-blowing, cut, and then subjected to a surface treatment like super-finishing or polishing for forming the tube. Besides, an endless nickel belt or an endless stainless steel belt as described in Japanese Patent Application Laid Open No. Sho 52-36016 may also be used as a conductive support body.

Moreover, the conductive supporting body 101BK can be coated with a conductive powder dispersed in a suitable binder resin. The examples of the conductive powder include carbon black, acetylene black, powders of metallic materials like aluminum, nickel, iron, nichrome, copper, zinc and silver, etc., and powders of metal oxides like conductive tin oxide. Moreover, the examples of the binder resin include thermoplastic, thermosetting or photosetting resins like polystyrene, styrene-acrylonitrile copolymer, styrene-butadiene copolymer, styrene-maleic acid anhydride copolymer, polyester, polyvinyl chloride, vinyl chloride-vinyl acetate copolymer, polyvinyl acetate, polyvinylidene chloride, polyallilate resin, phenoxy resin, polycarbonate, cellulose acetate resin, ethyl cellulose resin, polyvinylbutyral, polyvinylformal, polyvinyltoluene, poly-N-vinylcarbazole, acrylate resin, silicone resin, epoxy resin, melamine resin, urethane resin, phenol resin and alkyd resin, etc. The electrically conductive layer can be formed by coating the supporting body with a coating solution that is prepared by dispersing a conductive powder and a binder resin in a suitable solvent, such as tetrahydrofuran, dichloromethane, methylethylketone or toluene, etc. The electrically conductive layer may also be formed on a suitable cylindrical substrate by using a thermal contraction tube that contains a conductive powder mentioned above dispersed in a polymer material such as polyvinyl chloride, polypropylene, polyester, polystyrene, polyvinylidene chloride, polyethylene, chlorinated gum or Teflon™. The resulting structure can be well used as a conductive supporting body.

The photosensitive layer can be a single layer that is constituted of a charge transferring layer with a charge generating material dispersed therein, or a composite layer that is obtained by sequentially forming a charge generating layer and a charge transferring layer. The composite layer-type photosensitive body obtained by sequentially forming a charge generating layer 117BK and a charge transferring layer 118BK is described at first.

The charge generating layer is based on a charge generating material, and may also comprises a binder resin as required. The charge generating material can be an organic one as well as an inorganic one. The examples of the inorganic charge generating material include: crystalline selenium, amorphous selenium, selenium-tellurium, selenium-tellurium-halogen, selenium arsenide and amorphous silicon. The amorphous silicon material that contains hydrogen or halogen atoms on dangling bonds as terminal groups, or the one that is doped with boron or phosphorous, can be used as well.

The organic charge generating material can be one known in the prior art. The example include: phthalocyanine pigments like metal phthalocyanine and metal-free phthalocyanine, azulenium salt-based pigments, methine squalate-based pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadizole skeleton, azo pigments having a distyrylcarbazole skeleton, perylene-based pigments, anthraquinone-based or polycyclic quinone-based pigments, quinone imine-based pigments, diphenylmethane-based and triphenylmethane-based pigments, benzoquinone-based and naphthoquinone-based pigments, cyanine-based and azomethane-based pigments, indigoid-based pigments and bisbenzimidazole-based pigments. Each of the charge generating materials can be used alone or in combination with one or more among the others.

The examples of the binder resin that is used in the charge generating layer as required include: polyamide, polyurethane, epoxy resin, polyketone, polycarbonate, polyarylate, silicone resin, acrylate resin, polyvinylbutyral, polyvinylformal, polyvinylketone, polystyrene, poly-N-vinylcarbazole and polyacrylamide, etc. Each of the binder resins can be used alone or in combination with one or more among the others. Moreover, the binder resin used in the charge generating layer may be a polymeric charge transferring material itself, and a low-molecular-weight charge transferring material may be further added as required. The charge transferring materials that can be used with the chare generating layer include electron transferring materials and hole transferring materials, which are further classified into low-molecular-weight charge transferring materials and high-molecular-weight charge transferring materials. The high-molecular-weight charge transferring materials are called polymeric charge transferring materials later.

The examples of the electron transferring materials include the following electron accepting materials: chloranil, bromanil, tetracyanoethylene, tetacyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one and 1,3,7-trinitrodibenzothiophene-5,5-dioxide, etc. Each of the electron transportation materials can be used alone or in combination with one or more among the others.

The hole transferring materials as exemplified by the following electron donating materials can be used as well. The electron donating materials include oxazole derivatives, oxadiazole derivatives, imidazole derivatives, triphenylamine derivatives, 9-(p-diethylaminostyryl)anthracene, 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives and thiophene derivatives. Each of the hole transferring materials can be used alone or in combination with one or more among the others.

Moreover, the following polymeric charge transferring materials can also be used, including: polymers-having carbazole rings like poly-N-vinylcarbazole, polymers having hydrazone structures as described in Japanese Patent Application Laid Open No. Sho 57-78402, polysilirene polymers as described in Japanese Patent Application Laid Open No. Sho 63-285552, and polymers having triarylamine structures as described in Japanese Patent Application Laid Open No. Hei 7-325409, etc. Each of the polymeric charge transferring materials can be used alone or in combination with one or more among the others.

Though the aforementioned charge generating layer is based on charge generating materials, a solvent and a binder resin, some additives like sensitizing agents, dispersing agents, surfactants and silicon oil may be further included in the fabrication of the charge generating layer.

The methods for forming the charge generating layer mainly include vacuum filming methods and casting methods that utilize solution-dispersion systems. The vacuum filming methods include vacuum evaporation, glow discharge decomposition, ion plating, sputtering, reactive sputtering and chemical vapor deposition (CVD), etc, each of which can be well used for forming inorganic materials and organic materials. On the other hand, as a casting method is used to form the charge generating layer, the inorganic or organic charge generating materials and, if require, a binder resin are dispersed in a solvent such as tetrahydrofuran, cyclohexane, dioxane, dichloromethane or butanone, etc., by using a ball mill, an Atrita mill or a sand mill. The dispersion is moderately diluted and used for coating. The coating methods include dipping coating, spraying coating or bead coating, etc.

The thickness of the charge generating layer such formed suitably ranges from 0.01 μm to 5 μm, and preferably from 0.05 μm to 2 μm.

The charge transferring layer 118BK is described below in detail. The charge transferring layer is formed by dissolving or dispersing a mixture or a copolymer that is based on a charge transferring component and a binder component in a suitable solvent, and then performing a coating step and a drying step. The thickness of the charge transferring layer suitable ranges from 10 μm to 100 μm, and preferably from 10 μm to 30 μm as high resolution is required. The binder component can be a polymeric compound, of which the examples include thermoplastic and thermosetting resins like polystyrene, styrene/acrylonitrile copolymer, styrene/butadiene copolymer, styrene/maleic acid anhydride copolymer, polyester, polyvinyl chloride, vinyl chloride/vinyl acetate copolymer, polyvinyl acetate, polyvinylidene chloride, polyarylate resin, polycarbonate, cellulose acetate resin, ethyl cellulose resin, polyvinylbutyral, polyvinylformal, polyvinyltoluene, acrylate resin, silicone resin, fluorine resin, epoxy resin, melamine resin, urethane resin, phenol resin and alkyd resin, etc., but are not restricted to them. Each of the polymeric materials can be used alone or in combination with one or more among the others, or in copolymerization with a charge transferring material.

The examples of the materials that can be used as the charge transferring materials include the low-molecular-weight electron transferring materials and hole transferring materials, and the polymeric charge transferring materials mentioned above. As a low-molecular-weight charge transferring material is used, its amount is 20–200 weight parts, preferably 50–100 weight parts, relative to 100 weight parts of the polymeric compounds. On the other hand, as a polymeric charge transferring material is used, it is preferably used in copolymerization with a resin component, wherein the amount of the resin component ranges from n (n>0) to 500 weight parts relative to 100 weight parts of the polymeric charge transferring material.

The examples of the dispersing solvent used for preparing the coating solution of the charge transferring layer include: ketone compounds like methylethylketone, acetone, methylisobutylketone and cyclohexanone; ether compounds like dioxane, tetrahydrofuran and ethyl cellosolve; aromatic compounds like toluene and xylene; halide compounds like chlorobenzene and dichloromethane; and ester compounds like ethyl acetate and butyl acetate, etc.

As the charge transferring layer does not include a filler-enforced charge transferring layer 119BK as described below, it is necessary to add a filler material in at least the surface portion of the charge transferring layer for improving the wear resistance. The examples of organic filler materials include powders of fluorine resins like polytetrafluoroethylene, silicone resin powder and α-carbon powder, etc. The examples of inorganic filler materials include: powders of metallic materials like copper, tin, aluminum and indium; metal oxides like silica, tin oxide, zinc oxide, titanium oxide, alumina, indium oxide, antimony oxide, bismuth oxide, calcium oxide, tin oxide doped with antimony, and indium oxide doped with tin; metal fluorides like tin fluoride, calcium fluoride and aluminum fluoride; potassium titanate, and boron nitride, etc. Among the filler materials, the inorganic ones are preferable for improving the wear resistance. Moreover, each of the filler materials can be used alone or in combination with one or more among the others. To improve the dispersability of a filler materials in the coating solution or the film formed with coating, the surface of the filler material can be modified by using surface treating agents.

The filler material(s) can be dispersed in a solvent accompanying with a charge transferring material or a binder resin by using a suitable disperser. Moreover, the average of the primary particle sizes of the filler preferably ranges from 0.01 μm to 0.8 μm in consideration of the transparency or the wear resistance of the charge transferring layer. Moreover, though the filler may be distributed evenly in the charge transferring layer, the filler is preferably distributed with a concentration gradient to fit with the cases wherein the electrical potential of the illuminated portions is high. For the concentration gradient, the filler concentration in the outmost surface of the charge transferring layer is highest and that in the surface adjacent to the supporting body is lower. That is, the charge transferring layer is preferably constituted by plural layers, wherein the filler concentration increases gradually from the layer adjacent to the supporting body to the surface layer of the charge transferring layer. The thickness (the depth from the surface) of the inorganic filler layer on the surface side of the charge transferring layer is preferably larger than 0.5 μm, and more preferably larger than 2 μm.

As a filler-enforced charge transferring layer 119BK is disposed, however, the charge transferring layer 118BK is formed by dissolving or dispersing a mixture or a copolymer that is based on a charge transferring component and a binder component in a suitable solvent, and then performing a coating step and a drying step. The thickness of the charge transferring layer 118BK suitably ranges from 10 μm to 100 μm, and preferably from 10 μm to 30 μm as high resolution is required. The examples of the binder component that can be used in the charge transferring layer include the thermoplastic or thermosetting resins mentioned above, wherein each of the polymeric compounds can be used alone or in combination with one or more among the others, or in copolymerization with the charge transferring material.

The examples of the materials that can be used as the charge transferring materials include the low-molecular-weight electron transferring materials and hole transferring materials, and the polymeric charge transferring materials mentioned above. Moreover, if required, some low-molecular-weight compounds like anti-oxidants, plasticizers, lubricants, UV-absorbents and low-molecular-weight charge transferring materials, and leveling agents can be further added into the polymeric charge transferring materials. Each of the low-molecular-weight compounds can be used alone or in combination with one or more among the others. The addition amount of the low-molecular-weight compounds ranges from 0.1 to 200 weight parts, preferably from 0.1 to 30 weight parts, relative to 100 weight parts of the polymeric compound. The addition amount of the leveling agents suitably ranges from 0.001 to 5 weight parts relative to 100 weight parts of the polymeric compound.

The filler-enforced charge transferring layer 119BK is described as follows. A filler-enforced charge transferring layer means a functional layer that contains at least a charge transferring component, a binder resin component and a filler, and therefore has charge conductivity and mechanical resistance simultaneously. The filler-enforced charge transferring layer features with a charge mobility as high as that of a conventional charge transferring layer, and therefore is different from a surface protective layer. Moreover, the filler-enforced charge transferring layer can be used as a surface layer with a separate function in a multi-layer photosensitive body where the charge transferring layer is constituted by two or more layers. That is, the filler-enforced charge transferring layer is formed on a charge transferring layer that does not contain a filler, but is not used alone. Therefore, the filler-enforced charge transferring layer is different from the single-layer charge transferring layer in which a filler is dispersed as an additive.

The effective filler materials used in the filler-enforced charge transferring layer can be inorganic materials, especially titanium oxide and alumina, as explained in the descriptions about the charge transferring layer, while each of the filler materials can be used alone or in combination with one or more among the others. The surface of the filler can be modified with a surface treating agent to improve the dispersability of the filler in the coating solution and the film formed with coating, as mentioned above. The filler materials can be dispersed in a solvent accompany with a charge transferring material or a binder resin by using a suitable disperser. The average of the primary particle sizes of the filler preferably ranges from 0.01 μm to 0.8 μm in consideration of the transparency or the wear resistance of the charge transferring layer. The coating methods include dipping coating, spraying coating, ring coating, roll coating, gravure coating, nozzle coating and screen printing, etc. The thickness of the filler-enforced charge transferring layer is preferably larger than 0.5 μm, and preferably larger than 2 μm.

Next, the photosensitive layer constituted of a single layer 102BK is described as follows. The single-layer photosensitive layer is formed by dissolving or dispersing a charge generating material, a charge transferring material and a binder resin in a suitable solvent, and then performing a coating step and a drying step. Moreover, if required, plasticizers, leveling agents or anti-oxidants can be further added. The examples of the binder resin include those exemplified in the descriptions about the charge transferring layer 118BK, and those exemplified in the descriptions about the charge generating layer 117BK. In addition, the polymeric charge transferring materials exemplified above can also be used. The amount of the charge generating material is preferably 5–40 weight parts and that of the charge transferring material is 0–190 weight parts, preferably 50–150 weight parts, relative to 100 parts of the binder resin. The single-layer photosensitive layer can be formed by dispersing a charge generating material, a binder resin and a charge transferring material in a solvent like tetrahydrofuran, dioxane, dichloroethane or cyclohexane, and then coating the supporting body with the resulting coating solution by using dipping coating, spraying coating or bead coating. The thickness of the single-layer photosensitive layer suitably ranges from 5 μm to 25 μm. It the photosensitive layer is formed as an outmost surface layer, at least the surface of the photosensitive layer is required to contain a filler material. As in the case of the charge transferring layer mentioned above, the filler may be distributed evenly in the whole photosensitive layer, or is distributed with a concentration gradient. The latter design can be effectively achieved by constituting the photosensitive layer with plural layers and making the filler concentration vary gradually from layer to layer.

An underlayer can also be disposed between the conductive supporting body 101BK and the photosensitive layer. The underlayer is generally based on a resin material, while one highly resistant to ordinary organic solvents is required because the photosensitive layer will be applied onto the resin material by utilizing an organic solvent as a medium. The examples of the resin material include water-soluble resins like polyvinyl alcohol, casein and sodium polyacrylate; alcohol-soluble resins like copolymerized nylon and methoxymethylated nylon; and setting-type resins having three-dimensional crosslinking structures, such as polyurethane, melamine resin, phenol resin, alkyd-melamine resin, and epoxy resin, etc. Moreover, to avoid moiré and to reduce the residual electrical potential, a fine powder pigment of metal oxide, such as titanium oxide, silica, alumina, zirconium oxide, tin oxide or indium oxide, etc., can be further included in the fabrication of the under-layer. The underlayer can be formed by using a suitable solvent and a coating method, as in the case of the photosensitive layer. Moreover, the underlayer can be made from a silane-based coupling agent, a titanium-based coupling agent or a chromium-based coupling agent. Besides, the underlayer may be formed with $Al_2O_3$ thereon by using an anodization method, or with an organic material like polyparaxylylene (Parylene) or an inorganic material like $SiO_2$, $SnO_2$, $TiO_2$, ITO and $CeO_2$ thereon by using a vacuum filming method. Besides, the material of the underlayer can be one well known in the prior art. The thickness of the underlayer suitably ranges from 0 μm to 20 μm, and preferably from 1 μm to 10 μm.

Moreover, in the fabrication of each of the charge generating layer, the charge transferring layer, the under-layer, the protective layer and the intermediate layer, anti-oxidants, plasticizers, lubricants, UV-absorbents, low-molecular-weight charge transferring materials and leveling agents may be further included, so as to improve its environment resistance, particularly to avoid reduction of the photosensitivity and raising of the residual electrical potential. The examples of the compounds serving as additives are described as follows.

The anti-oxidants that can be included in the fabrication of each layer are exemplified below, but not limited to:

(a) phenol compounds 2,6-di-t-butyl-p-cresol, butylated hydroxyanisole, 2,6,-di-t-butyl-4-ethylphenol, n-octadecyl-3-(4'-hydroxy-3',5'-di-t-butylphenol), 2,2'-methylene-bis(4-methyl-6-t-butylphenol), 2,2'-methylene-bis(4-ethyl-6-t-butylphenol), 4,4'-thio-bis(3-methyl-6-t-butylphenol), 4,4'-butylidene-bis(3-methyl-6-t-butylphenol), 1,1,3-tris(2-methyl-4-hydroxy-5-t-butylphenyl)butane, 1,3,5-trimethyl-2,4,6-tris(3,5-di-t-butyl-4-hydroxybenzyl) benzene, tetrakis[methylene-3-(3',5'-di-t-butyl-4'-hydroxyphenyl) propionate]methane, bis[3,3'-bis(4'- hydroxy-3'-t-butylphenyl)butyric acid]glycol ester and tocopherol compounds, etc.

(b) para-phenylenediamine compounds

N-phenyl-N'-isopropyl-p-phenylenediamine, N,N'-di-sec-butyl-p-phenylenediamine, N-phenyl-N-sec-butyl-p-phenylenediamine, N,N'-diisopropyl-p-phenylenediamine, and N,N'-dimethyl-N,N'-di-t-butyl-p-phenylenediamine, etc.

(c) hydroquinone compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone and 2-(2-octadecenyl)-5-methylhydroquinone, etc.

(d) organic sulfur compounds dilauryl-3,3'-thiodipropionate, distearyl-3,3'-thiodipropionate and ditetradecyl-3'3,-thiodipropionate, etc.

(e) organic phosphorous compounds triphenylphosphine, tri(nonylphenyl)phosphine, tri(dinonylphenyl)phosphine, tricresylphosphine and tri(2,4-dibutylphenoxy)phosphine, etc.

The plasticizers that can be included in the fabrication of each layer are exemplified below, but not limited to:

(a) phosphate ester plasticizers triphenyl phosphate, tricresyl phosphate, trioctyl phosphate, octyl diphenyl phosphate, trichloroethyl phosphate, cresyl diphenyl phosphate, tributyl phosphate, tri(2-ethylhexyl) phosphate and triphenyl phosphate.

(b) phthalate ester plasticizers dimethyl phthalate, diethyl phthalate, diisobutyl phthalate, dibutyl phthalate, diheptyl phthalate, di(2-ethylhexyl) phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butyl benzyl phthalate, butyl lauryl phthalate, methyl oleyl phthalate, octyl decyl phthalate, dibutyl phthalate and dioctyl phthalate, etc.

(c) aromatic carboxylate ester plasticizers trioctyl trimellitate, tri-n-octyl trimellitate and octyl oxybenzoate, etc.

(d) aliphatic dibasic acid ester plasticizers dibutyl adipate, di-n-hexyl adipate, di(2-ethylhexyl) adipate, di-n-octyl adipate, n-octyl n-decyl adipate, diisodecyl adipate, dicapryl adipate, di(2-ethylhexyl) azalate, dimethyl sebacate, diethyl sebacate, dibutyl sebacate, di-n-octyl sebacate, di(2-ethylhexyl) sebacate, di(2-ethoxyethyl) sebacate, dioctyl succinate, diisodecyl succinate, dioctyl tetrahydrophthalate and di-n-octyl tetrahydrophthalate, etc.

(e) aliphatic acid ester derivatives butyl oleate, glycerol monooleate ester, methyl acetylricinoleate, pentaerythritol ester, dipentaerythritol hexaester, triacetine and tributyrin, etc.

(f) oxyacid ester ploasticizers methyl acetylricinoleate, buyl acetylricinoleate, butyl phthatyl butyl glycolate and tributyl acetylcitrate, etc.

(g) epoxy plasticizers epoxylated soybean oil, epoxylated linseed oil, butyl epoxystearate, decyl epoxystearate, octyl epoxystearate, benzyl epoxystearate, dioctyl epoxyhexahydrophthalate and didecyl epoxyhexahydrophthalate, etc.

(h) dihydric alcohol ester plasticizers diethylene glycol dibenzoate and triethylene glycol di-2-ethylbutyrate, etc.

(i) chlorine-containing plasticizers chlorinated paraffin, chlorinated diphenyl, chlorinated aliphatic acid methyl ester and methoxychlorinated aliphatic acid methyl ester, etc.

(j) polyester plasticizers polypropylene adipate, polypropylene sebacate, polyester and acetylated polyester, etc.

(k) sulfonic acid derivatives p-toluenesulfone amide, o-toluenesulfone amide, p-toluenesulfone ethyl amide, o-toluenesulfone ethyl amide, toluenesulfone-N-ethyl amide and p-toluenesulfone-N-cyclohexyl amide, etc.

(l) citric acid derivatives triethyl citrate, triethyl acetylcitrate, tributyl citrate, tributyl acetylcitrate, tri-2-ethylhexyl acetylcitrate and n-octyl decyl acetylcitrate, etc.

(m) misc.

terphenyl, partially hydrogenated terphenyl, camphor, 2-nitrodiphenyl, dinonylnaphthalene and methyl abietate, etc.

The lubricants that can be included in the fabrication of each layer are exemplified below, but not limited to:

(a) hydrocarbon compounds fluid paraffin, paraffin wax, micro wax and lowly polymerized polyethylene, etc.

(b) aliphatic acids lauric acid, myristic acid, palmitic acid, stearic acid, arachidic acid and behenic acid, etc.

(c) aliphatic acid amide compounds stearyl amide, palmityl amide, olein amide, methylene bisstearoamide and ethylene bisstearoamide, etc.

(d) ester compounds lower alcohol esters of aliphatic acids, polyhydric alcohol esters of aliphatic acids and aliphatic acid polyglycol esters, etc.

(e) alcohol compounds cetyl alcohol, stearyl alcohol, ethylene glycol, polyethylene glycol and polyglycerol, etc.

(f) metallic soaps lead stearate, cadmium stearate, barium stearate, calcium stearate, zinc stearate and magnesium stearate, etc.

(g) natural waxes carnauba wax, candelilla wax, bee's wax, spermaceti, insect wax and Montan wax.

(h) misc.

silicone compounds and fluorine-containing compounds, etc.

The UV-absorbents that can be included in the fabrication of each layer are exemplified below, but not limited to:

(a) benzophenone series 2-hydroxybenzophenone, 2,4-dihydroxybenzophenone, 2,2',4-trihydroxybenzophenone, 2,2',4,4'-tetrahydroxybenzophenone and 2,2'-dihydroxy-4-methoxybenzophenone, etc.

(b) salcilate series phenyl salcilate and 2,4-di-t-butylphenyl 3,5-di-t-butyl-4-hydroxybenzoate, etc.

(c) benzotriazole series (2'-hydroxyphenyl)benzotrizole, (2'-hydroxy-5'-methylphenyl)benzotrizole, (2'-hydroxy-5'-methylphenyl) benzotrizole and (2'-hydroxy-3'-t-butyl-5'-methylphenyl)-5-chlorobenzotrizole, etc.

(d) cyanoacrylate series ethyl-2-cyano-3,3-diphenyl acrylate and methyl-2-carbomethoxy-3-(para-methoxy) acrylate, etc.

(e) quenchers (metal complexes)

nickel (2,2'-thiobis(4-t-octyl) phenolate)-n-butyl-amine, nickel dibutyldithiocarbamate, nickel dibutyldithiocarbamate and cobalt dicyclohexyldithiophosphate, etc.

(f) HALS (hindered amine)

bis(2,2,6,6-tetramethyl-4-piperidyl) sebacate, bis(1,2,2,6,6-pentamethyl-4-piperidyl) sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpyridine, 8-benzyl-7,7,9,9-tetramethyl-3-octyl-1,3,8-triazaspiro[4,5]undecane-2,4-dione and 4-benzoyloxy-2,2,6,6-tetramethylpiperidine, etc.

Next, the fabrication of an image carrier formed from a photosensitive body will be explained with an example, which is not intended to restrict the scope of this invention.

An underlayer coating liquid, a charge generating layer coating liquid and a charge transferring layer coating liquid that have compositions described later are sequentially used to coat an aluminum drum having a diameter of 30 mm and dried, thereby forming an underlayer, a charge generating layer and a charge transferring layer of 3.5 μm, 0.2 μm and 28 μm, respectively, in thickness. Then, an inorganic filler coating liquid as described below is used to coat the above structure with spraying coating method, thereby forming a filler-enforced charge transferring layer having a thickness of 1.5 μm and completing an electrophotographic photosensitive body. The inorganic filler coating liquid mentioned above is prepared by pulverizing all components in a solvent with zirconia beads and a paint shaker.

| [Underlayer coating liquid] | |
|---|---|
| alkyd (Beckosol 1307-60-EL produced by DAINIPPON INK AND CHEMICALS, INCORPORATED) | 6 weight parts |
| melamine (Super-Beckamin G-821-60 by DAINIPPON INK AND CHEMICALS, INCORPORATED) | 4 weight parts |
| titanium oxide (CR-EL by ISHIHARA SANGYO KAISHA, LTD.) | 40 weight parts |
| methylethylketone | 200 weight parts |
| [Charge generating layer coating liquid] | |
| oxo-titanium phthalocyanine pigment | 2 weight parts |
| polyvinylbutyral (UCC: XYHL) | 0.2 weight part |
| tetrahydrofuran | 50 weight parts |

| [Charge transferring layer coating liquid] | |
|---|---|
| polycarbonate resin (Z-POLYCA, viscosity average molecular weight: 50,000, produced by TEIJIN CHEMICALS, LTD.) | 12 weight parts |
| low-molecular-weight charge transferring material of formula (3) | 10 weight parts |

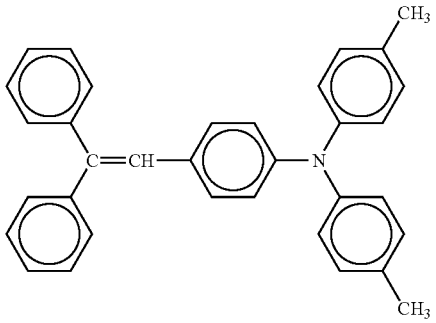

(3)

-continued

| [Charge transferring layer coating liquid] | |
|---|---|
| tetrahydrofuran | 100 weight parts |
| Solution of silicone oil (KF50-100CS by Shin-Etsu Chemical Co., Ltd.) of 1 wt % in tetrahydrofuran | 1 weight part |

| [Coating liquid for the filler-enforced charge transferring layer] | |
|---|---|
| polycarbonate resin (Z-POLYCA, viscosity average molecular weight: 50,000, produced by TEIJIN CHEMICALS, LTD.) | 4 weight parts |
| low-molecular-weight charge transferring material of formula (4) | 3 weight parts |

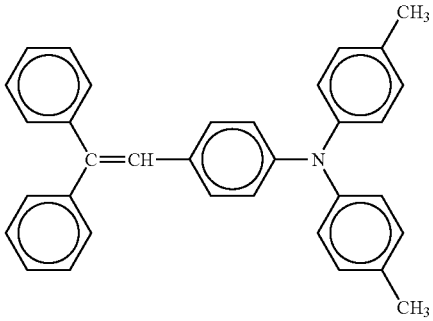

(4)

| | |
|---|---|
| α-alumina (SUMICORUNDUM AA-03 by Sumitomo Chemical Co., Ltd.) | 0.7 weight part |
| cyclohexanone | 280 weight parts |
| tetrahydrofuran | 80 weight parts |

It is noted that what are mentioned above are specific examples of the constitution of the image forming means, while specific examples of the constitution of the intermediate transfer body 10 formed as an endless belt are explained below.

The intermediate transfer body formed as an endless belt is conventionally constituted by fluorine resin, polycarbonate resin or polyimide resin. Recently, however, an intermediate transfer body may be constituted of an elastic belt that is itself an elastic layer or contains an elastic layer. As an intermediate transfer body formed as a resin belt is used for transferring color images, the following issues are encountered.

A color image is usually formed from toners of four colors, and is constituted by from one to four toner layers. The toner layers are subjected to a pressure at the primary transfer site (for toner transfer from the image carrier to the intermediate transfer body) or at the secondary transfer site (for toner transfer from the intermediate transfer body to the recording medium), so the condensing force between the toners is larger. Therefore, drop-outs of words or edge drop-outs of solid parts of images easily occur.

Moreover, since the intermediate transfer body formed as a resin belt has a high hardness so that the toner layers are deformed, the toner layers are easily compressed to cause drop-outs of words. Moreover, it is recently highly required that an image can be transferred to various kinds of paper, such as Japanese paper or the one that is purposely made rough. However, as a rough paper is used in image transfer, gaps are formed between the concave portions of the paper and the toner, so transfer drop-outs are easily caused. Particularly, since a high transfer pressure is applied to the secondary transfer site for achieving good adhesion between the toners and the recording medium, the condensing force between the toners is high, and drop-outs of words are caused.

To solve this problem, an elastic belt can be used instead since it is softer than the resin belt and therefore allows the toner layers to deform in consistence with the surface of a rough paper. That is, the elastic belt can deform following the local surface topologies of the recording medium, so the transfer pressure applied to the toner layers will not be raised overly, and the adhesion of the toners are improved so that drop-outs of words are not found. Therefore, highly uniform transfer images can be obtained even though a rough paper is used.

Accordingly, the image forming apparatus of this embodiment uses the intermediate transfer body 10 illustrated in FIG. 11, as described above. The intermediate transfer body 10 is mainly composed of a base layer 11 and an elastic layer 12, wherein the base layer is constituted by a poorly stretchable material like a fluorine resin that is relatively less stretchable, or a gum material or a canvas that is relatively more stretchable. The elastic layer 12 is disposed on the base layer 11, and is constituted by, for example, fluorine gum or copolymerized acrylonitrile-butadiene gum. The surface of the elastic layer 12 is covered with a surface layer 13 that has a good smoothness and is formed by, for example, fluorine resin coating. The specific examples of the materials of the layers 11–13 are described below.

The resins that can be used to form the base layer 11 are selected from the group consisting of polycarbonate, fluorine resins (ETFE and PVDF); styrene-based resins (homopolymers or copolymers containing styrene units or substituted styrene units) like polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate ester copolymers (styrene-methyl acrylate copolymer, styrene-ethyl acrylate copolymer, styrene-butyl acrylate copolymer, styrene-octyl acrylate copolymer and styrene-phenyl acrylate copolymer), styrene-methacrylate ester copolymers (styrene-methyl methacrylate copolymer, styrene-ethyl methacrylate copolymer and styrene-phenyl methacrylate copolymer), styrene-methyl α-chloroacrylate copolymer and styrene-acrylonitrile-acrylate ester copolymer, etc.; methyl methacrylate resin, butyl methacrylate resin, ethyl acrylate resin, butyl acrylate resin, modified acrylate resins (silicone-modified acrylate resin, vinyl chloride resin-modified acrylate resin and acrylate-urethane resin), vinyl chloride resin, styrene-vinyl acetate copolymer, vinyl chloride-vinyl acetate copolymer, rosin-modified maleate resin, phenol resins, epoxy resins, polyester resins, polyester-polyurethane resins, polyethylene, polypropylene, polybutadiene, polyvinylidene chloride, ionomer resin, polyurethane resin, silicone resin, ketone resin, ethylene-ethyl acrylate copolymer, xylene resins and polyvinylbutyral resin, polyamide resins and modified polyphenylene oxide resins. The feasible materials are not merely restricted to those mentioned above.

The resins (elastomers) that can be used to form the elastic layer 12 are selected from the group consisting of butyl gum, fluorine gum, acrylate gum, EPDM, NBR, acrylonitrile-butadiene-styrene gum, natural gum, isoprene gum, styrene-butadiene gum, butadiene gum, ethylene-propylene gum, ethylene-propylene terpolymer, chloroprene gum, chlorosulfonated polyethylene, chlorinated polyethylene, urethane gum, syndiotactic 1,2-polybutadiene, epichlorohydrin gum, silicone gum, fluorine gum, polysulfide gum, polynorbornene gum, hydrogenated nitrile gum and thermoplastic elastomers (e.g., polystyrene-based, polyolefin-based, polyvinyl chloride-based, polyurethane-based, polyamide-based, polyurea-based, polyester-based or fluorine resin-based thermoplastic elastomers). The feasible materials are not merely restricted to those mentioned above.

The surface layer 13 is required to have a small adhesive force for the toners on the intermediate transfer body and thereby have a high secondary transferrability. The surface layer 13 is formed by, for example, dispersing powders or particles of one or more materials that have low surface energies and high lubricity, such as fluorine resin, fluorine-containing compounds, carbon fluoride, titanium dioxide or silicon carbide, in one or more materials selected from the group consisting of polyurethane, polyester and epoxy resin, wherein the particles may have different sizes. Moreover, as a fluorine gum is used as the material of the surface layer 13, a thermal treatment can be performed to form a fluorine-rich layer that has a small surface energy.

Moreover, if required, resistance-regulating conductive agents can be included in the fabrication of the base layer 11, the elastic layer 12 or the surface layer 13. The examples of the agents include: carbon black, graphite, powders of metallic materials like aluminum or nickel; conductive metal oxides like tin oxide, titanium oxide, antimony oxide, indium oxide, potassium titanate, antimony oxide/tin oxide composite material (ATO) and indium oxide/tin oxide composite material (ITO). The surfaces of the conductive metal oxides may also be covered with fine particles of insulating materials like barium sulfate, magnesium silicate and calcium carbonate. The feasible materials are not merely restricted to those mentioned above.

The thickness of the elastic layer 12 is set according to the hardness thereof. A larger thickness (approximately larger than 1 mm) is not preferable since it increases the deformation amount of the surface of the elastic layer 12, and cracks easily occurs on the surface layer. Moreover, the deformation amount of a transferred image is increased accordingly. The hardness "HS" of the elastic layer 12 suitably ranges from 10° to 65° in JIS-A specification, while the optimum hardness is determined with the thickness of the belt layer. As the hardness is lower than 10° (JIS-A), it is quite difficult to mold the elastic layer 12 with high precision in dimensions because shrinkage and expansion easily occur in the molding process. Moreover, as the elastic layer 12 is softer, the base material thereof generally contains an oil component, and the oil component easily diffuses out in continuous operations under a pressurized state. Consequently, the image carrier contacting with the surface of the intermediate transfer body is contaminated, and band-like unevenness is caused. Even though a surface layer is further disposed to improve the releasability, the qualities (e.g., durability) of the surface layer is still highly required for avoiding the surface layer from being entirely soaked by the oil component, and selecting a suitable material and maintaining its properties are both difficult. On the contrary, as the hardness is higher than 65° (JIS-A), the elastic layer 12 can be molded with high precision, and an oil component is eliminated or greatly reduced so that contamination of the image carrier can be reduced. However, the effects in transferrability improvement, including the effect of reducing drop-outs of words, are not obtained, and it is difficult to mount the intermediate transfer body on the rollers.

The method for fabricating the intermediate transfer body is not particularly restricted, while the following methods are exemplified:

Centrifugal molding method, which forms a belt by flowing a material into a rotating cylindrical die;

Spraying coating method, which forms a thin film on a surface by spraying;

Dipping method, which dips a cylindrical die into a solution of a material, and then lifts the die;

Injection molding method, which injects a material into between an inner die and an outer die; and The method of winding a compound in a cylindrical die and then vulcanizing and polishing the compound.

However, the feasible methods are not restricted to those mentioned above, and the belt surely can be fabricated with a combination of two or more methods.

A specific example of the fabrication of the intermediate transfer body is described below. A cylindrical die is firstly dipped in a dispersion that is prepared by dispersing 100 weight parts of PVDF, 18 weight parts of carbon black and 3 weight parts of a dispersing agent in 400 weight parts of toluene, and is then smoothly lifted with a speed of 10 mm/sec. The solution film on the die is dried under room temperature to form a uniform PVDF film of 75 μm in thickness. The above step is repeated once again to form an endless PVDF belt of totally 150 μm in thickness. The cylindrical die with the PVDF belt of 150 μm formed thereon is then dipped into a dispersion that is prepared by evenly dispersing 100 weight parts of polyurethane prepolymer, 3 weight parts of a hardening agent (isocyanate), 20 weight parts of carbon black and 3 weight parts of a dispersing agent in 500 weight parts of MEK, lifted with a speed of 30 mm/sec, and then dried naturally. The above step is repeated again and again until a urethane polymer layer of 150 μm in thickness is formed. The dispersion used for forming the surface layer is prepared by evenly dispersing 100 weight parts of polyurethane prepolymer, 3 weight parts of a hardening agent (isocyanate), 50 weight parts of fine powder of PTFE and 3 weight parts of a dispersing agent in 500 weight parts of MEK. The cylindrical die with the polyurethane prepolymer layer of 150 μm formed thereon is then dipped into the dispersion for forming the surface layer, lifted with a speed of 30 mm/sec, and then dried naturally. The above step is repeated again and again until a surface layer of urethane polymer that has a thickness of 5 μm and has PTFE powder evenly dispersed therein is formed. The resulting structure is dried under room temperature, and then subjected to a crosslinking treatment under 130° C. for 2 hours. Finally, a transfer belt is obtained comprising three layers, i.e., a base layer, an elastic layer and a surface layer that have thickness of 150 μm, 150 μm and 5 μm, respectively.

As mentioned above, it is possible to prevent the intermediate transfer body from stretching because the intermediate transfer body is constituted by a less stretchable base layer and an elastic layer. However, it is also feasible to prevent the intermediate transfer body from stretching by constituting it with a core layer and a surface layer coated on the surface thereof, wherein the core layer simultaneously serves as a base layer and an elastic. The core layer is constituted by an elastic material and at least one anti-stretching material. For example, the anti-stretching material (s) can be one or more materials selected from the group consisting of natural fibers like cotton and silk; synthetic fibers like polyester fiber, nylon fiber, acrylate fiber, polyolefin fiber, polyvinyl alcohol fiber, polyvinyl chloride fiber, polyvinylidene chloride fiber, polyurethane fiber, polyacetal fiber, polyfluoroethylene fiber and phenol fiber; inorganic fibers like carbon fiber, glass fiber and boron fiber; and metal fibers like iron fiber and copper fiber. Each of the fibers can be used in a state of textiles or threads. Beside, the feasible materials are not restricted to those mentioned above.

Each thread can be twisted with one or more filaments, and may be present as a single twisting, a plied yarn or a double thread. Moreover, one or more fibers selected from the aforementioned group may be spun mixed for use. Moreover, the thread can be applied with a suitable conductivity treatment before use. On the other hand, a textile formed by using a specific weaving method, such as knitted weaving, can also be used. Moreover, a cross-woven textile can be used, and a conductivity treatment can also be applied to a textile-type belt.

The core layer can be fabricated by using the following methods, for example. In one method, a cylindrically woven textile is applied to a die, and is then covered with a layer of elastic material. In another method, a cylindrically woven textile is dipped into a liquid gum for disposing a covering layer on one side or two sides of the core layer. In still another method, a thread is spirally wound on a die or the like with an arbitrary pitch, and is then covered with a layer of elastic material.

On the other hand, the cleaning device 17 that is used for the intermediate transfer body illustrated in FIGS. 1–2 has two fur brushes 90 and 91 as cleaning members. The specifications of the fur brush 90 or 91 are, for example: diameter=20 mm; material=acrylcarbon; 6.25 D/F; 100,000 fibers/inch$^2$; and volume resistance=$10^7$ Ω·cm. The fur brush is disposed opposite to and contacting with the intermediate transfer body 10, while being rotated in a counter direction. Meanwhile, the two fur brushes 90 and 91 are applied with two biases that have different polarities from a power source not shown, and each of the two fur brushes 90 and 91 is disposed contacting with a metal roller 92 or 93 and rotated clockwise or counterclockwise. Moreover, the metal roller 92 on the upstream side in the moving direction of the intermediate transfer body 10 is applied with a negative voltage from a power source 94, and the metal roller 93 on the downstream side in the moving direction of the intermediate transfer body 10 is applied with a positive voltage from a power source 95. In addition, two blades 96 and 97 are pressed onto the metal rollers 92 and 93, respectively, with their tips. The intermediate transfer body 10 is driven in the arrow direction, and its surface is firstly cleaned by the fur brush 90 on the upstream side, wherein the fur brush 90 is applied with a negative voltage, for example. As the metal roller 92 is applied with a voltage of −700V, a voltage of −400V is induced on the fur brush 90, so the positively charged toners on the intermediate transfer body 10 move to the fur brush 90. The removed toners further move from the fur brush 90 to the metal roller 92 because of the voltage difference, and are then scratched by the blade 96.

Though the fur brush 90 is capable of removing toners from the intermediate transfer body 10, there are still some toners remaining on the intermediate transfer body 10. The remaining toners have been negatively charged with the negative bias applied to the fur brush 90 with a mechanism like charge injection or discharge. Therefore, the fur brush 91 on the downstream side is applied with a positive bias and used for removing the remaining toners. The removed toners further move from the fur brush 91 to the metal roller 93 because of the voltage difference, and are then scratched by the blade 97. The toners scratched by the blades 96 and 97 are recovered by a tank (not shown).

With the cleaning of the fur brush 91, most of the toners on the intermediate transfer body 10 can be removed, but there are still residual toners remaining on the intermediate transfer body 10. The residual toners have been positively charged with the positive bias applied to the fur brush 91. The positively charged residual toners are transferred back to the image carrier because of the transfer electric field established at the primary transfer site, and are then recovered by the cleaning device of the image carrier. Moreover, the residual toners are mainly transferred to the starting point of the primary transfer site. On the other hand, the sequence of forming images of different colors on the image carriers is not restricted to that mentioned before, but can be adjusted according to the targets and the characteristics of the image forming apparatus.

Furthermore, the resist roller 49 is generally grounded in use, but may be applied with a bias for removing paper powders coming from the recording medium. For example, the resist roller can be a conductive gum roller that is applied with a bias. More specifically, the resist roller can be a roller of 18 mm in diameter with a conductive NBR gum layer having a thickness of 1 mm. The volume resistance of the gum material is $10^9$ Ω·cm, and the voltage applied to the toner transfer side (surface side) is −800V, while the inner side of the recording medium is applied with a voltage of +200V. Generally, the paper powder hardly moves to the image carrier in an intermediate transfer process, so it is little required to consider the problem of paper powder transfer, and the resist roller 49 on the inner side may be grounded as before. Moreover, though a pure DC voltage can be applied to the resist roller 49, an AC voltage with a DC offset may be applied as well for evenly charging the recording medium. After passing the resist roller 49 applied with such a bias, the surface of the recording medium is slightly negatively charged. Therefore, as compared with the case where the resist roller 49 is not applied with a voltage, the conditions for the image transfer from the intermediate transfer body 10 to the recording medium can be adjusted properly according to the variations of transfer conditions.

Figure 18:
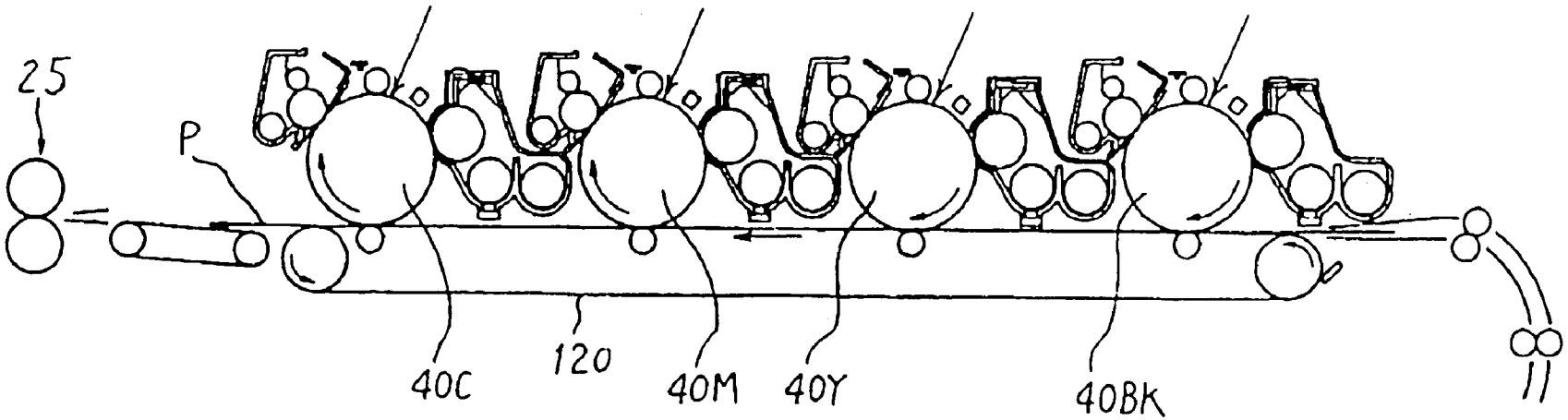
FIG. 18 illustrates a cross-sectional view of an image forming apparatus according to another embodiment of this invention.

Though the invention is explained with an image forming apparatus that includes a plurality of image carriers, on which toner images of different colors are formed, and uses an intermediate transfer body for transferring the toner images, the invention can be applied to various types of image forming apparatuses. One exemplary image forming apparatus forms a single-color toner image on an image carrier, and then transfers the toner image to a recording medium. Another exemplary image forming apparatus forms a synthetic toner image on an image carrier, and then transfers the toner image to a recording medium. Still another exemplary image forming apparatus sequentially forms and transfers toner images of different colors from an image carrier to a recording medium. A further example of image forming apparatus is illustrated in FIG. 18, wherein the toner images of different colors are formed on plural image carriers 40BK, 40Y, 40M and 40C, respectively, and then sequentially transferred to a recording medium transported by a sheet transporting belt 120. The synthetic toner image is then fixed on the recording medium by a fixing device 25. Furthermore, this invention can be applied to other categories of image forming apparatuses like printers or facsimile machines, or the image forming apparatuses formed from composite machines that integrate at least two different machines selected from electronic copy machines, printers and facsimile machines.

The image forming apparatus illustrated in FIG. 18 directly transfers the toner image on each image carrier to a recording medium, as mentioned above, and therefore is called a direct-transfer image forming apparatus. On the contrary, the image forming apparatus illustrated in FIG. 1 firstly transfers the toner image on each image carrier to an intermediate transfer body and then transfers the synthetic toner image from the intermediate transfer body to a recording medium, and therefore is called an indirect-transfer image forming apparatus. In the former case, the fixing device 25 is disposed on the downstream side of the transportation direction of the recording medium relative to the transporting belt 120, so the image forming apparatus is larger in transverse direction. In the latter case, however, the secondary transfer site can be set more freely, and the fixing device 25 can be disposed under the intermediate transfer body 10. Therefore, the size of the image forming apparatus in the transverse direction can be reduced. Moreover, in the former case, the fixing device 25 is required to dispose near the transporting belt 120 to avoid size increase, so the mechanical shock occurring as the recording medium enters the fixing device 25 is large. In the latter case, however, the distance between the secondary transfer site and the fixing device 25 can be increased, so there is a margin before the recording medium is transported into the fixing device 25. Therefore, the mechanical shock occurring as the recording medium enters the fixing device 25 can be reduced.

As mentioned above, this invention is capable of inhibiting variation of the width of the small gap (between an image carrier and a charging member) with time, and therefore is capable of forming high-quality images for a long time.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A charging device, comprising:

a charging member disposed opposite to a surface of an image carrier, wherein the image carrier is charged with a voltage applied to the charging member, and the charging member comprises a substrate and a resistor layer thereon, wherein end portions of the resistor layer are provided with indents configured to mount gap holders adhered to the indents by an adhesive layer positioned in the indents, the gap holders being configured to contact the image carrier while providing a gap between the image carrier and the resistor layer between the gap holders, wherein the resistor layer comprises a resistance regulating layer on the substrate and a surface layer on the resistance regulating layer, and wherein a base material of the resistance regulating layer includes a gum or a resin that has a hardness higher than 80 in JIS-A specification.

2. The charging device of claim 1, wherein the gap holders protrude above the resistor layer between them by from 5 μm to 500 μm.

3. The charging device of claim 1, wherein the surface layer on the resistance regulating layer between the gap holders has a thickness from 1 μm to 20 μm.

4. The charging device of claim 1, further comprising a cleaning member, said cleaning member being configured to contact the charging member for cleaning the charging member.

5. The charging device of claim 4, wherein the charging member comprises a rotating body, and the cleaning member is supported in contact with the charging member and rotated accompanying with the charging member.

6. The charging device of claim 4, wherein the cleaning member comprises a brush.

7. The charging device of claim 4, wherein the cleaning member is supported so that it can be moved back and forth and swung on the charging member.

8. A process cartridge, comprising a charging device as described in claim 1 and an image carrier charged by the charging device.

9. An image forming apparatus, comprising the charging device as described in claim 1 and the image carrier charged by the charging device.

10. The image forming apparatus of claim 9, wherein the image carrier has an image carrier surface layer containing fillers.

11. A charging device, comprising:

a charging member disposed opposite to a surface of an image carrier, wherein the image carrier is charged with a voltage applied to the charging member, and the charging member comprises a substrate and a resistor layer thereon, wherein end portions of the resistor layer are provided with indents configured to mount gap holders adhered to the indents by an adhesive layer positioned in the indents, the gap holders being configured to contact the image carrier while providing a gap between the image earner and the resistor layer between the gap holders, wherein the resistor layer comprises a resistance regulating layer on the substrate and a surface layer on the resistance regulating layer, and wherein the resistance regulating layer comprises a base material and a resistance regulating agent that has an amount from 30 wt % to 90 wt %.

* * * * *